US010524072B2

(12) United States Patent
Habets et al.

(10) Patent No.: US 10,524,072 B2
(45) Date of Patent: Dec. 31, 2019

(54) APPARATUS, METHOD OR COMPUTER PROGRAM FOR GENERATING A SOUND FIELD DESCRIPTION

(71) Applicant: Fraunhofer-Gesellschaft zur Förderung der angewandten Forschung e.V., München (DE)

(72) Inventors: Emanuel Habets, Spardorf (DE); Oliver Thiergart, Erlangen (DE); Fabian Küch, Erlangen (DE); Alexander Niederleitner, Nürnberg (DE); Affan-Hasan Khan, Erlangen (DE); Dirk Mahne, Nürnberg (DE)

(73) Assignee: Fraunhofer-Gesellschaft zur Förderung der angewandten Forschung e.V. (DE)

( * ) Notice: Subject to any disclaimer, the term of this patent is extended or adjusted under 35 U.S.C. 154(b) by 0 days.

(21) Appl. No.: 15/933,155

(22) Filed: Mar. 22, 2018

(65) Prior Publication Data

US 2019/0098425 A1 Mar. 28, 2019

Related U.S. Application Data

(63) Continuation of application No. PCT/EP2017/055719, filed on Mar. 10, 2017.

(30) Foreign Application Priority Data

Mar. 15, 2016 (EP) ..... 16160504

(51) Int. Cl.
*H04S 3/00* (2006.01)
*H04R 3/00* (2006.01)
(Continued)

(52) U.S. Cl.
CPC ..... *H04S 3/008* (2013.01); *G10L 19/008* (2013.01); *H04R 3/005* (2013.01); *H04R 5/027* (2013.01);
(Continued)

(58) Field of Classification Search
CPC ..... G10L 19/008; G10L 19/20; G10L 19/167; H04S 2420/11; H04S 2400/01; H04S 2420/03
(Continued)

(56) References Cited

U.S. PATENT DOCUMENTS 8,374,365 B2 * 2/2013 Goodwin ..... H04S 1/002 381/17
2011/0216908 A1 9/2011 Galdo
(Continued)

FOREIGN PATENT DOCUMENTS

EP 2800401 A1 11/2014
FR 2858512 2/2005
(Continued)

OTHER PUBLICATIONS

R. K. Furness, "Ambisonics—An overview," in AES 8th International Conference, Apr. 1990, pp. 181-189.
(Continued)

*Primary Examiner* — Alexander Jamal
(74) *Attorney, Agent, or Firm* — Haynes and Boone, LLP

(57) ABSTRACT

An apparatus for generating a sound field description having a representation of sound field components, including a direction determiner for determining one or more sound directions for each time-frequency tile of a plurality of time-frequency tiles of a plurality of microphone signals; a spatial basis function evaluator for evaluating, for each time-frequency tile of the plurality of time-frequency tiles, one or more spatial basis functions using the one or more
(Continued)

sound directions; and a sound field component calculator for calculating, for each time-frequency tile of the plurality of time-frequency tiles, one or more sound field components corresponding to the one or more spatial basis functions evaluated using the one or more sound directions and a reference signal for a corresponding time-frequency tile, the reference signal being derived from one or more microphone signals of the plurality of microphone signals.

22 Claims, 16 Drawing Sheets

(51) Int. Cl.
*G10L 19/008* (2013.01)
*H04R 5/027* (2006.01)

(52) U.S. Cl.
CPC ..... *H04S 2400/15* (2013.01); *H04S 2420/11* (2013.01)

(58) Field of Classification Search
USPC ..... 381/22, 23, 310
See application file for complete search history.

(56) References Cited

U.S. PATENT DOCUMENTS

| | | | | |
|---|---|---|---|---|
| 2011/0286609 | A1 | 11/2011 | Faller | |
| 2012/0314876 | A1 | 12/2012 | Vilkamo | |
| 2013/0259243 | A1 | 10/2013 | Herre | |
| 2014/0358559 | A1 | 12/2014 | Sen et al. | |
| 2016/0035386 | A1* | 2/2016 | Morrell | G10L 19/008 700/94 |

FOREIGN PATENT DOCUMENTS

| | | | |
|---|---|---|---|
| WO | WO 2006006809 | A1 | 1/2006 |
| WO | WO 2015086377 | A1 | 6/2015 |

OTHER PUBLICATIONS

C. Nachbar, F. Zotter, E. Deleflie, and A. Sontacchi, "AMBIX—A Suggested Ambisonics Format", Proceedings of the Ambisonics Symposium 2011.

M. Williams and G. Le Du, "Multichannel Microphone Array Design," in Audio Engineering Society Convention 108, 2000.

J. Vilkamo and V. Pulkki, "Minimization of Decorrelator Artifacts in Directional Audio Coding by Covariance Domain Rendering ", J. Audio Eng. Soc, vol. 61, No. 9, 2013.

O. Thiergart and E. A. P. Habets, "Extracting Reverberant Sound Using a Linearly Constrained Minimum Variance Spatial Filter," IEEE Signal Processing Letters, vol. 21, No. 5, May 2014.

V. Pulkki, "Directional audio coding in spatial sound reproduction and stereo upmixing," in Proceedings of the AES 28th International Conference, pp. 251-258, Jun. 2006.

J. Meyer and T. Agnello, "Spherical microphone array for spatial sound recording," in Audio Engineering Society Convention 115, Oct. 2003.

R. Roy, A. Paulraj, and T. Kailath, "Direction-of-arrival estimation by subspace rotation methods—ESPRIT," in IEEE International Conference on Acoustics, Speech, and Signal Processing (ICASSP), Stanford, CA, USA, Apr. 1986.

E. G. Williams, "Fourier Acoustics: Sound Radiation and Nearfield Acoustical Holography," Academic Press, 1999.

S. Berge and N. Barrett, "High Angular Resolution Planewave Expansion," in 2nd International Symposium on Ambisonics and Spherical Acoustics, May 2010.

O. Thiergart, M. Taseska, and E. A. P. Habets, "An Informed Parametric Spatial Filter Based on Instantaneous Direction-of-Arrival Estimates," IEEE/ACM Transactions on Audio, Speech, and Language Processing, vol. 22, No. 12, Dec. 2014.

H. Lee and C. Gribben, "On the optimum microphone array configuration for height channels," in 134 AES Convention, Rome, 2013.

R. Schmidt, "Multiple emitter location and signal parameter estimation," IEEE Transactions on Antennas and Propagation, vol. 34, No. 3, pp. 276-280, 1986.

B. D. Van Veen and K. M. Buckley, "Beamforming: A versatile approach to spatial filtering", IEEE ASSP Magazine, vol. 5, No. 2, 1988.

B. Raoand and K .Hari,"Performance analysis of root-MUSIC," in Signals, Systems and Computers, 1988. Twenty-Second Asilomar Conference on, vol. 2, pp. 578-582, 1988.

M. Zoltowski and C. P. Mathews, "Direction finding with uniform circular arrays via phase mode excitation and beamspace root-MUSIC," in Acoustics, Speech, and Signal Processing, 1992. ICASSP-92., 1992 IEEE International Conference on, vol. 5, 1992, pp. 245-248.

O. Thiergart, G. Del Galdo, and E A. P. Habets, "On the spatial coherence in mixed sound fields and its application to signal-to-diffuse ratio estimation", The Journal of the Acoustical Society of America, vol. 132, No. 4, 2012.

J.-S. Jiang and M.-A. Ingram, "Robust detection of number of sources using the transformed rotational matrix," in Wireless Communications and Networking Conference, 2004. WCNC. 2004 IEEE, vol. 1, Mar. 2004.

D. P. Jarrett, O. Thiergart, E. A. P. Habets, and P. A. Naylor, "Coherence-Based Diffuseness Estimation in the Spherical Harmonic Domain," IEEE 27th Convention of Electrical and Electronics Engineers in Israel (IEEE!), 2012.

F. Zotter, "Analysis and Synthesis of Sound-Radiation with Spherical Arrays", PhD thesis, University of Music and Performing Arts Graz, 2009.

O. Thiergart, G. Del Galdo, M. Taseska, and E. A. P. Habets, "Geometry-based Spatial Sound Acquisition Using Distributed Microphone Arrays," IEEE Transactions on in Audio, Speech, and Language Processing, vol. 21, No. 12, Dec. 2013.

A. Favrot et al.: "Perceptually Motivated Gain Filter Smoothing for Noise Suppression", Audio Engineering Society Convention, p. 123, 2007.

A. Mhamdi et al.: "Direction of Arrival Estimation for Nonunifrom Linear Antenna", Communications, computing and control Applications (CCCA), 2011, pp. 1-5.

F.Hollerweger_An Introduction to Higher Order Ambisonic, pp. 1-13, XP055156176, online copy available at http://flo.rnur.at/writings/HOA.intro.pdf.

A. Laborie et al.: "A New Comprehensive Approach of Surround Sound Recording", Audio Engineering Society Convention Paper, presented at the 114$^{th}$ Convention, Amsterdam, the Netherlands, Mar. 22-25, 2003, pp. 1-19, XP002280618.

Russian Patent Office; Decision to Grant; dated Mar. 12, 2019; parallel Russian patent application No. 2018121969.

* cited by examiner

- time-frequency tile (10, 1)

has DOA $\vec{n}$ (10, 1) $\vec{n}$: unit norm vector

- time-frequency tile (5, 2) $\vec{n} = \begin{pmatrix} n_x \\ n_y \\ n_z \end{pmatrix}$ 3-D case has DOA $\vec{n}$ (5, 2) $\vec{n} = \begin{pmatrix} n_x \\ n_y \end{pmatrix}$ 2-D case

- spatial basis functions $Y_i$ (DOA)

e.g. $i = 1$ : omnidirectional
$i = 2$ : directional in x direction
$i = 3$ : directional in y direction
$i = 4$ : directional in z direction
⋮

$\Downarrow$ evaluated spatial basis functions $G_i$ (k, n)

for time-frequency tiles

| | | | | | |
|---|---|---|---|---|---|
| ... | ... $G_1(10, 1)$ | | ... $G_1(5, 2)$ | ... | ... |
| | $G_2(10, 1)$ | | $G_2(5, 2)$ | | |
| | $G_3(10, 1)$ | | $G_3(5, 2)$ | | |
| | $G_4(10, 1)$ | | $G_4(5, 2)$ | | |
| | for block n = 1 | | for block n = 2 | | |

Fig. 1E time domain representation of sound field components $b_i$

APPARATUS, METHOD OR COMPUTER PROGRAM FOR GENERATING A SOUND FIELD DESCRIPTION

CROSS-REFERENCES TO RELATED APPLICATIONS

This application is a continuation of co-pending International Application No. PCT/EP2017/055719, filed Mar. 10, 2017, which is incorporated herein by reference in its entirety, and additionally claims priority from European Application No. EP 16 160 504.3, filed Mar. 15, 2016, which is incorporated herein by reference in its entirety.

The present invention relates to an apparatus, a method or a computer program for generating a Sound Field Description and also to a synthesis of (Higher-order) Ambisonics signals in the time-frequency domain using sound direction information

BACKGROUND OF THE INVENTION

The present invention is in the field of spatial sound recording and reproduction. Spatial sound recording aims at capturing a sound field with multiple microphones such that at the reproduction side, a listener perceives the sound image as it was at the recording location. Standard approaches for spatial sound recording usually use spaced omnidirectional microphones (e.g. in AB stereophony), or coincident directional microphones (e.g. in intensity stereophony). The recorded signals can be reproduced from a standard stereo loudspeaker setup to achieve a stereo sound image. For surround sound reproduction, for example, using a 5.1 loudspeaker setup, similar recording techniques can be used, for example, five cardioid microphones directed towards the loudspeaker positions [ArrayDesign]. Recently, 3D sound reproduction systems have emerged, such as the 7.1+4 loudspeaker setup, where 4 height speakers are used to reproduce elevated sounds. The signals for such a loudspeaker setup can be recorded for example with very specific spaced 3D microphone setups [MicSetup3D]. All these recordings techniques have in common that they are designed for a specific loudspeaker setup, which limits the practical applicability, for example, when the recorded sound should be reproduced on different loudspeaker configurations.

More flexibility is achieved when not directly recording the signals for a specific loudspeaker setup, but instead recording the signals of an intermediate format, from which the signals of an arbitrary loudspeaker setup can then be generated on the reproduction side. Such an intermediate format, which is well-established in practice, is represented by (higher-order) Ambisonics [Ambisonics]. From an Ambisonics signal, one can generate the signals of every desired loudspeaker setup including binaural signals for headphone reproduction. This involves a specific renderer which is applied to the Ambisonics signal, such as a classical Ambisonics renderer [Ambisonics], Directional Audio Coding (DirAC) [DirAC], or HARPEX [HARPEX].

An Ambisonics signal represents a multi-channel signal where each channel (referred to as Ambisonics component) is equivalent to the coefficient of a so-called spatial basis function. With a weighted sum of these spatial basis functions (with the weights corresponding to the coefficients) one can recreate the original sound field in the recording location [FourierAcoust]. Therefore, the spatial basis function coefficients (i.e., the Ambisonics components) represent a compact description of the sound field in the recording location. There exist different types of spatial basis functions, for example spherical harmonics (SHs) [FourierAcoust] or cylindrical harmonics (CHs) [FourierAcoust]. CHs can be used when describing the sound field in the 2D space (for example for 2D sound reproduction) whereas SHs can be used to describe the sound field in the 2D and 3D space (for example for 2D and 3D sound reproduction).

The spatial basis functions exist for different orders l, and modes m in case of 3D spatial basis functions (such as SHs). In the latter case, there exist $m=2l+1$ modes for each order l, where m and l are integers in the range $l \geq 0$ and $-l \leq m \leq l$. A corresponding example of spatial basis functions is shown in FIG. 1*a*, which shows spherical harmonic functions for different orders l and modes m. Note that the order l is sometimes referred to as levels, and that the modes m may be also referred to as degrees. As can be seen in FIG. 1*a*, the spherical harmonic of the zeros order (zeroth level) $l=0$ represents the omnidirectional sound pressure in the recording location, whereas the spherical harmonics of the first order (first level) $l=1$ represent dipole components along the three dimensions of the Cartesian coordinate system. This means, a spatial basis function of a specific order (level) describes the directivity of a microphone of order l. In other words, the coefficient of a spatial basis function corresponds to the signal of a microphone of order (level) l and mode m. Note that the spatial basis functions of different orders and modes are mutually orthogonal. This means for example that in a purely diffuse sound field, the coefficients of all spatial basis functions are mutually uncorrelated.

As explained above, each Ambisonics component of an Ambisonics signal corresponds to a spatial basis function coefficient of a specific level (and mode). For example, if the sound field is described up to level $l=1$ using SHs as spatial basis function, then the Ambisonics signal would comprise four Ambisonics components (since we have one mode for order $l=0$ plus three modes for order $l=1$). Ambisonics signals of a maximum order $l=1$ are referred to as first-order Ambisonics (FOA) in the following, whereas Ambisonics signals of a maximum order $l>1$ are referred to as higher-order Ambisonics (HOA). When using higher orders l to describe the sound field, the spatial resolution becomes higher, i.e., one can describe or recreate the sound field with higher accuracy. Therefore, one can describe a sound field with only fewer orders leading to a lower accuracy (but less data) or one can use higher orders leading to higher accuracy (and more data).

There exist different but closely related mathematical definitions for the different spatial basis functions. For example, one can compute complex-valued spherical harmonics as well as real-valued spherical harmonics. Moreover, the spherical harmonics may be computed with different normalization terms such as SN3D, N3D, or N2D normalization. The different definitions can be found for example in [Ambix]. Some specific examples will be shown later together with the description of the invention and the embodiments.

The desired Ambisonics signal can be determined from recordings with multiple microphones. The straightforward way of obtaining Ambisonics signals is the direct computation of the Ambisonics components (spatial basis function coefficients) from the microphone signals. This approach involves measuring the sound pressure at very specific positions, for example on a circle or on the surface of a sphere. Afterwards, the spatial basis function coefficients can be computed by integrating over the measured sound pressures, as described for example in [FourierAcoust, p. 218]. This direct approach involves a specific microphone setup, for example, a circular array or a spherical array of omnidirectional microphones. Two typical examples of commercially available microphone setups are the Sound-Field ST350 microphone or the EigenMike® [EigenMike]. Unfortunately, the requirement of a specific microphone geometry strongly limits the practical applicability, for example when the microphones need to be integrated into a small device or if the microphone array needs to be combined with a video camera.

Moreover, determining the spatial coefficients of higher orders with this direct approach involves a relatively high number of microphones to assure a sufficient robustness against noise. Therefore, the direct approach of obtaining an Ambisonics signal is often very expensive.

SUMMARY

According to an embodiment, an apparatus for generating a sound field description having a representation of sound field components may have: a direction determiner for determining one or more sound directions for each time-frequency tile of a plurality of time-frequency tiles of a plurality of microphone signals; a spatial basis function evaluator for evaluating, for each time-frequency tile of the plurality of time-frequency tiles, one or more spatial basis functions using the one or more sound directions; and a sound field component calculator for calculating, for each time-frequency tile of the plurality of time-frequency tiles, one or more sound field components corresponding to the one or more spatial basis functions using the one or more spatial basis functions evaluated using the one or more sound directions and using a reference signal for a corresponding time-frequency tile, the reference signal being derived from one or more microphone signals of the plurality of microphone signals.

According to another embodiment, a method of generating a sound field description having a representation of sound field components may have the steps of: determining one or more sound directions for each time-frequency tile of a plurality of time-frequency tiles of a plurality of microphone signals; evaluating, for each time-frequency tile of the plurality of time-frequency tiles, one or more spatial basis functions using the one or more sound directions; and calculating, for each time-frequency tile of the plurality of time-frequency tiles, one or more sound field components corresponding to the one or more spatial basis functions using the one or more spatial basis functions evaluated using the one or more sound directions and using a reference signal for a corresponding time-frequency tile, the reference signal being derived from one or more microphone signals of the plurality of microphone signals.

Another embodiment may have a non-transitory digital storage medium having a computer program stored thereon to perform the method of generating a sound field description having a representation of sound field components, having the steps of: determining one or more sound directions for each time-frequency tile of a plurality of time-frequency tiles of a plurality of microphone signals; evaluating, for each time-frequency tile of the plurality of time-frequency tiles, one or more spatial basis functions using the one or more sound directions; and calculating, for each time-frequency tile of the plurality of time-frequency tiles, one or more sound field components corresponding to the one or more spatial basis functions using the one or more spatial basis functions evaluated using the one or more sound directions and using a reference signal for a corresponding time-frequency tile, the reference signal being derived from one or more microphone signals of the plurality of microphone signals, when said computer program is run by a computer.

The present invention relates to an apparatus or a method or a computer program for generating a sound field description having a representation of sound field components. In a direction determiner, one or more sound directions for each time-frequency tile of a plurality of time-frequency tiles of a plurality of microphone signals is determined. A spatial basis function evaluator evaluates, for each time-frequency tile of the plurality of time-frequency tiles, one or more spatial basis functions using the one or more sound directions. Furthermore, a sound field component calculator calculates, for each time-frequency tile of the plurality of time-frequency tiles, one or more sound field components corresponding to the one or more spatial basis functions evaluated using the one or more sound directions and using a reference signal for a corresponding time frequency tile, wherein the reference signal is derived from the one or more microphone signals of the plurality of microphone signals.

The present invention is based on the finding that a sound field description describing an arbitrary complex sound field can be derived in an efficient manner from a plurality of microphone signals within a time-frequency representation consisting of time-frequency tiles. These time-frequency tiles, on the one hand, refer to the plurality of microphone signals and, on the other hand, are used for determining the sound directions. Hence, the sound direction determination takes place within the spectral domain using the time-frequency tiles of the time-frequency representation. Then, the major part of the subsequent processing is advantageously performed within the same time-frequency representation. To this end, an evaluation of spatial basis functions is performed using the determined one or more sound directions for each time-frequency tile. The spatial basis functions depend on the sound directions but are independent on the frequency. Thus, an evaluation of the spatial basis functions with frequency domain signals, i.e., signals in the time-frequency tiles is applied. Within the same time-frequency representation, one or more sound field components corresponding to the one or more spatial basis functions that have been evaluated using the one or more sound directions are calculated together with a reference signal also existing within the same time-frequency representation.

These one or more sound field components for each block and each frequency bin of a signal, i.e., for each time-frequency tile can be the final result or, alternatively, a conversion back into the time domain can be performed in order to obtain one or more time domain sound field components corresponding to the one or more spatial basis functions. Depending on the implementation, the one or more sound field components can be direct sound field components determined within the time-frequency representation using time-frequency tiles or can be diffuse sound field components typically to be determined in addition to the direct sound field components. The final sound field components having a direct part and the diffuse part can then be obtained by combining direct sound field components and diffuse sound field components, wherein this combination may be performed either in the time domain or in the frequency domain depending on the actual implementation.

Several procedures can be performed in order to derive the reference signal from the one or more microphone signals. Such procedures may comprise the straightforward selection of a certain microphone signal from the plurality of microphone signals or an advanced selection that is based on the one or more sound directions. The advanced reference signal determination selects a specific microphone signal from the plurality of microphone signals that is from a microphone located closest to the sound direction among the microphones from which the microphone signals have been derived. A further alternative is to apply a multichannel filter to the two or more microphone signals in order to jointly filter those microphone signals so that a common reference signal for all the frequency tiles of a time block is obtained. Alternatively, different reference signals for different frequency tiles within a time block can be derived. Naturally, different reference signals for different time blocks but for the same frequencies within the different time blocks can be generated as well. Therefore, depending on the implementation, the reference signal for a time-frequency tile can be freely selected or derived from the plurality of microphone signals.

In this context, it is to be emphasized that the microphones can be located in arbitrary locations. The microphones can have different directional characteristics, too.

Furthermore, the plurality of microphone signals do not necessarily have to be signals that have been recorded by real physical microphones. Instead, the microphone signals can be microphone signals that have been artificially created from a certain sound field using certain data processing operations that mimic real physical microphones.

For the purpose of determining diffuse sound field components in certain embodiments, different procedures are possible and are useful for certain implementations. Typically, a diffuse portion is derived from the plurality of microphone signals as the reference signal and this (diffuse) reference signal is then processed together with an average response of the spatial basis function of a certain order (or a level and/or a mode) in order to obtain the diffuse sound component for this order or level or mode. Therefore, a direct sound component is calculated using the evaluation of a certain spatial basis function with a certain direction of arrival and a diffuse sound component is, naturally, not calculated using a certain direction of arrival but is calculated by using the diffuse reference signal and by combining the diffuse reference signal and the average response of a spatial basis function of a certain order or level or mode by a certain function. This functional combining can, for example, be a multiplication as can also be performed in the calculation of the direct sound component or this combination can be a weighted multiplication or an addition or a subtraction, for example when calculations in the logarithmic domain are performed. Other combinations different from a multiplication or addition/subtraction are performed using a further non-linear or linear function, wherein non-linear functions are advantageous. Subsequent to the generation of the direct sound field component and the diffuse sound field component of a certain order, a combination can be performed by combining the direct sound field component and the diffuse sound field component within the spectral domain for each individual time/frequency tile. Alternatively, the diffuse sound field components and the direct sound field components for a certain order can be transformed from the frequency domain into the time domain and then a time domain combination of a direct time domain component and a diffuse time domain component of a certain order can be performed as well.

Depending on the situation, further decorrelators can be used for decorrelating the diffuse sound field components. Alternatively, decorrelated diffuse sound field components can be generated by using different microphone signals or different time/frequency bins for different diffuse sound field components of different orders or by using a different microphone signal for the calculation of the direct sound field component and a further different microphone signal for the calculation of the diffuse sound field component.

In an embodiment, the spatial basis functions are spatial basis functions associated with certain levels (orders) and modes of the well-known Ambisonics sound field description. A sound field component of a certain order and a certain mode would correspond to an Ambisonics sound field component associated with a certain level and a certain mode. Typically, the first sound field component would be the sound field component associated with the omnidirectional spatial basis function as indicated in FIG. 1*a* for order l=0 and mode m=0.

The second sound field component could, for example, be associated with a spatial basis function having a maximum directivity within the x direction corresponding to order l=1 and mode m=−1 with respect to FIG. 1*a*. The third sound field component could, for example, be a spatial basis function being directional in the y direction which would correspond to mode m=0 and order l=1 of FIG. 1*a* and a fourth sound field component could, for example, be a spatial basis function being directional in the z direction corresponding to mode m=1 and order l=1 of FIG. 1*a*.

However, other sound field descriptions apart from Ambisonics are, of course, well-known to those skilled in the art and such other sound field components relying on different spatial basis functions from Ambisonics spatial basis functions can also be advantageously calculated within the time-frequency domain representation as discussed before.

Embodiments of the following invention describe a practical way of obtaining Ambisonics signals. In contrast to the aforementioned state-of-the-art approaches, the present approach can be applied to arbitrary microphone setups which possess two or more microphones. Moreover, the Ambisonics components of higher orders can be computed using relatively few microphones only. Therefore, the present approach is comparatively cheap and practical. In the proposed embodiment, the Ambisonics components are not directly computed from sound pressure information along a specific surface, as for the state-of-the-art approaches explained above, but they are synthesized based on a parametric approach. For this purpose, a rather simple sound field model is assumed, similar to the one used for example in DirAC [DirAC]. More precisely, it is assumed that the sound field in the recording location consists of one or a few direct sounds arriving from specific sound directions plus diffuse sound arriving from all directions. Based on this model, and by using parametric information on the sound field such as the sound direction of the direct sounds, it is possible to synthesis the Ambisonics components or any other sound field components from only few measurements of the sound pressure. The present approach is explained in detail in the following sections.

BRIEF DESCRIPTION OF THE DRAWINGS

Embodiments of the present invention will be detailed subsequently referring to the appended drawings, in which:

FIG. 1E illustrates the evaluation of exemplary four spatial basis functions using the sound directions for the identified frequency bins (10, 1) and (5, 2);

DETAILED DESCRIPTION OF THE INVENTION

Figure 1A:
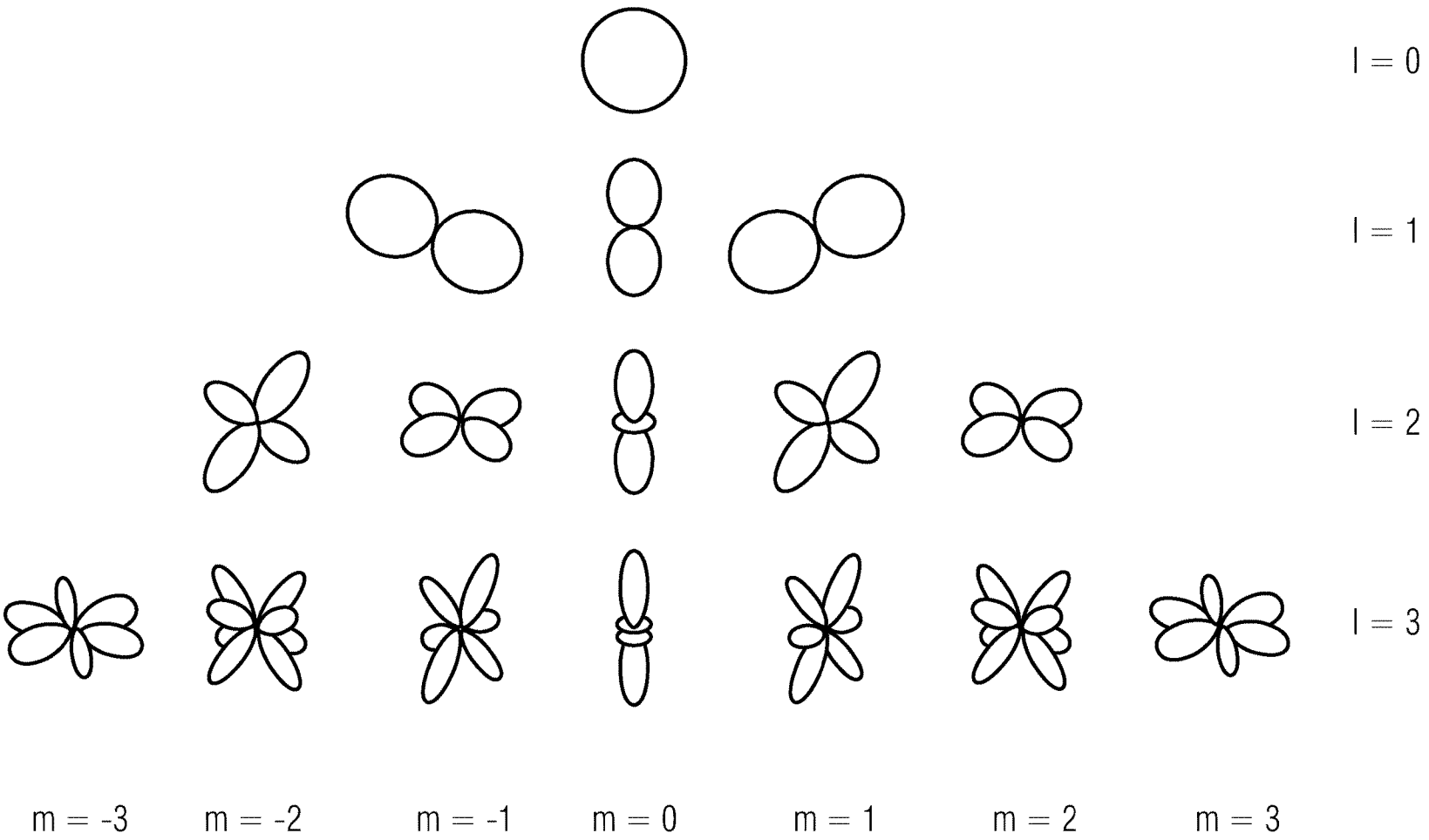
FIG. 1A shows spherical harmonic functions for different orders and modes.
Figure 1B:
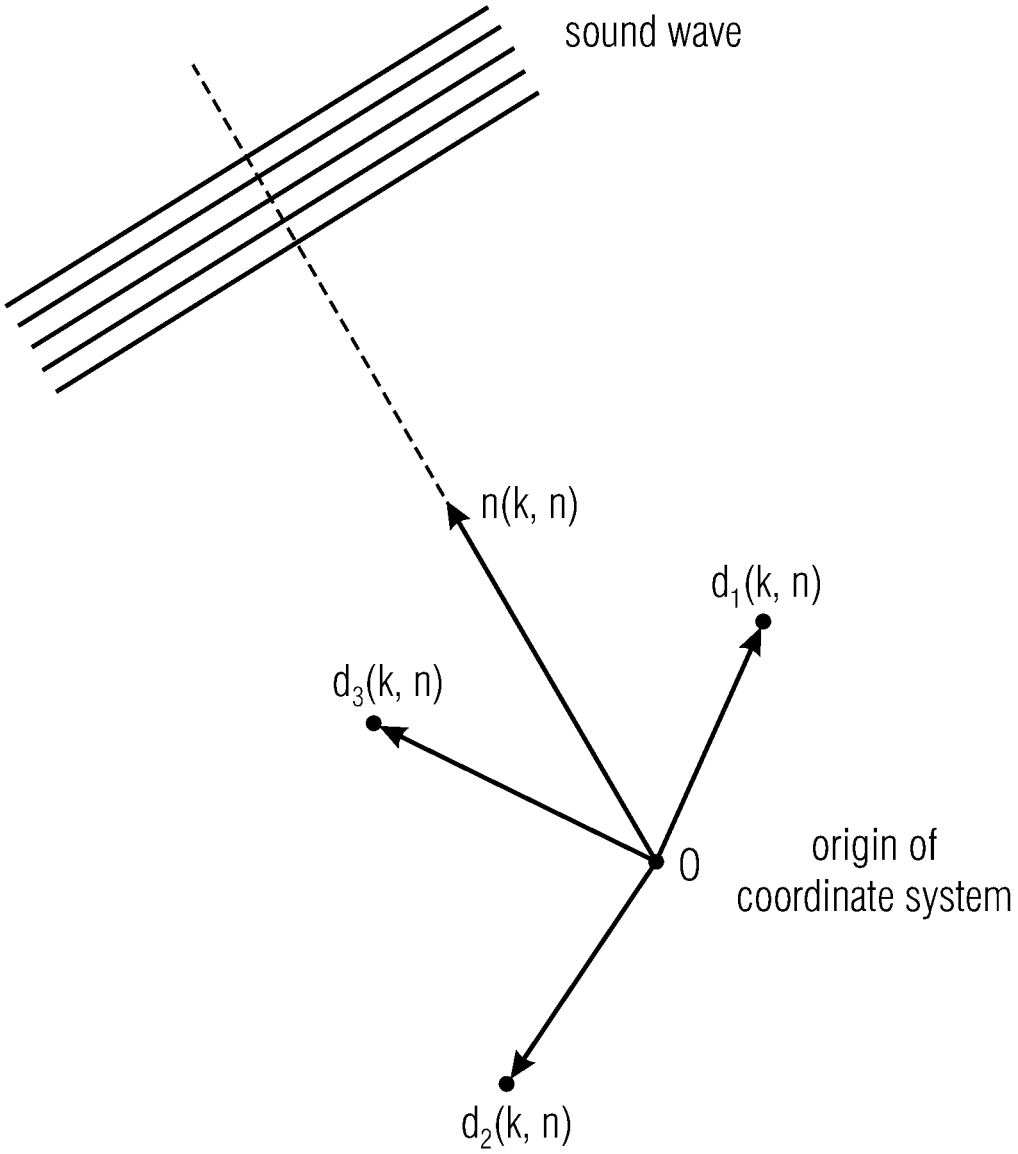
FIG. 1B shows one example of how to select the reference microphone based on direction-of-arrival information.
Figure 1C:
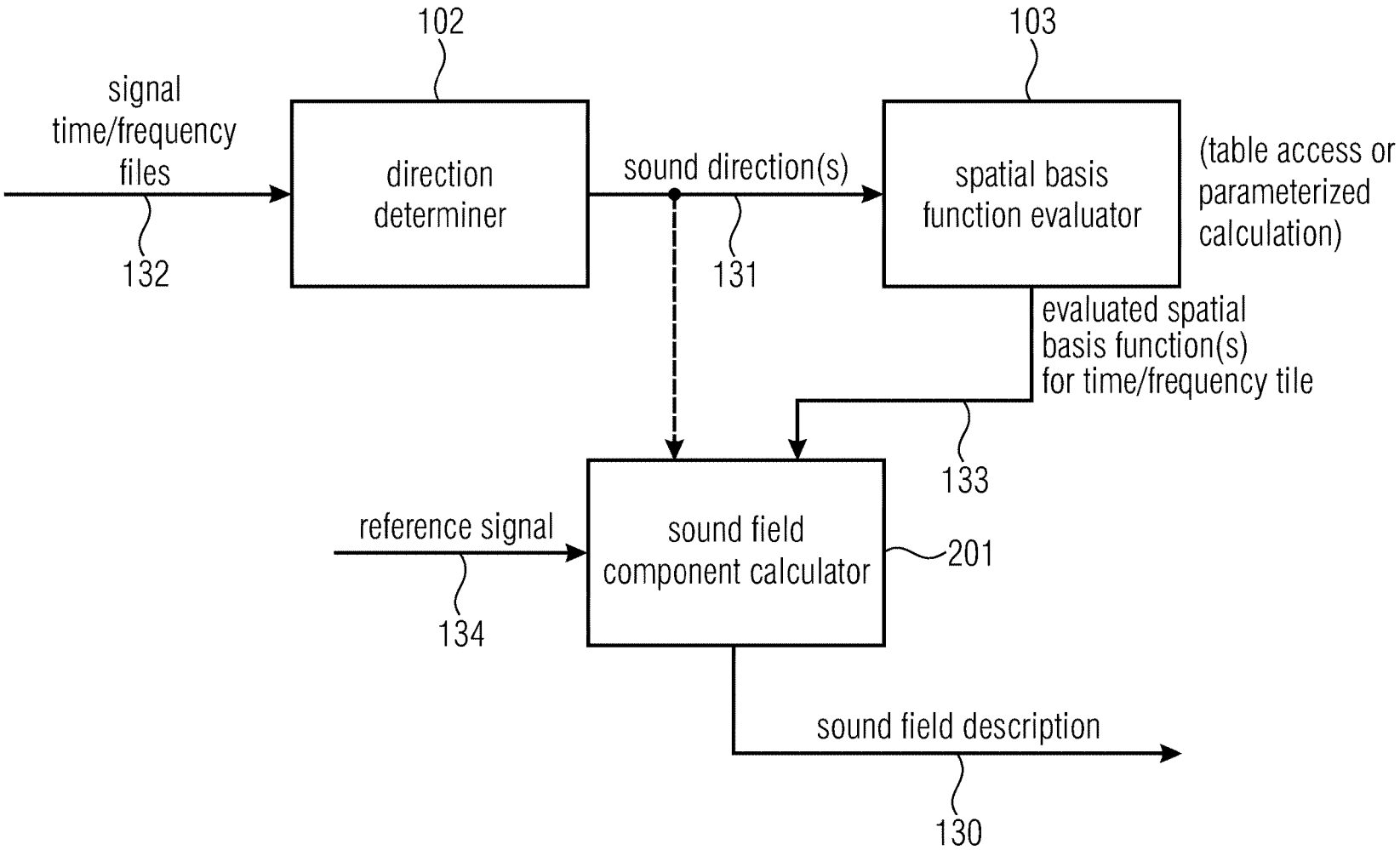
FIG. 1C shows an implementation of an apparatus or method for generating a sound field description.

An embodiment is illustrated in FIG. 1C. FIG. 1C illustrates an embodiment of an apparatus or method for generating a sound field description 130 having a representation of sound field components such as a time domain representation of sound field components or a frequency domain representation of sound field components, an encoded or decoded representation or an intermediate representation.

To this end, a direction determiner 102 determines one or more sound directions 131 for each time-frequency tile of a plurality of time-frequency tiles of a plurality of microphone signals.

Thus, the direction determiner receives, at its input 132, at least two different microphone signals and, for each of those two different microphone signals, a time-frequency representation typically consisting of subsequent blocks of spectral bins is available, wherein a block of spectral bins has associated therewith a certain time index n, wherein the frequency index is k. A block of frequency bins for a time index represents a spectrum of the time domain signal for a block of time domain samples generated by a certain windowing operation.

The sound directions 131 are used by a spatial basis function evaluator 103 for evaluating, for each time-frequency tile of the plurality of time-frequency tiles, one or more spatial basis functions. Thus, the result of the processing in block 103 is one or more evaluated spatial basis functions for each time-frequency tile. Advantageously, two or even more different spatial basis functions are used such as four spatial basis functions as discussed with respect to FIGS. 1E and 1F. Thus, at the output 133 of block 103, the evaluated spatial basis functions of different orders and modes for the different time-frequency tiles of the time-spectrum representation are available and are input into the sound field component calculator 201. The sound field component calculator 201 additionally uses a reference signal 134 generated by a reference signal calculator (not shown in FIG. 1C). The reference signal 134 is derived from one or more microphone signals of the plurality of microphone signals and is used by the sound field component calculator within the same time/frequency representation.

Hence, the sound field component calculator 201 is configured to calculate, for each time-frequency tile of the plurality of time-frequency tiles, one or more sound field components corresponding to the one or more spatial basis functions evaluated using the one or more sound directions with the help of one or more reference signals for the corresponding time-frequency tile.

Depending on the implementation, the spatial basis function evaluator 103 is configured to use, for a spatial basis function, a parameterized representation, wherein a parameter of the parameterized representation is a sound direction, the sound direction being one-dimensional in a two-dimensional situation or two-dimensional in a three-dimensional situation, and to insert a parameter corresponding to the sound direction into the parameterized representation to obtain an evaluation result for each spatial basis function.

Alternatively, the spatial basis function evaluator is configured to use a look-up table for each spatial basis function having, as in input, a spatial basis function identification and the sound direction and having, as an output, an evaluation result. In this situation, the spatial basis function evaluator is configured to determine, for the one or more sound directions determined by the direction determiner 102, a corresponding sound direction of the look-up table input. Typically, the different direction inputs are quantized in a way so that, for example, a certain number of table inputs exists such as ten different sound directions.

The spatial basis function evaluator 103 is configured to determine, for a certain specific sound direction not immediately coinciding with a sound direction input for the look-up table, the corresponding look-up table input. This can, for example, be performed by using, for a certain determined sound direction, the next higher or next lower sound direction input into the look-up table. Alternatively, the table is used in such a way that a weighted mean between the two neighboring look-up table inputs is calculated. Thus, the procedure would be that the table output for the next lower direction input is determined. Furthermore, the look-up table output for the next higher input is determined and then an average between those values is calculated.

This average can be a simple average obtained by adding the two outputs and dividing the results by two or can be a weighted average depending on the position of the determined sound direction with respect to the next higher and next lower table output. Thus, exemplarily, a weighting factor would depend on the difference between the determined sound direction and the corresponding next higher/next lower input into the look-up table. For example, when the measured direction is close to the next lower input then the look-up table result for the next lower input is multiplied by a higher weighting factor compared to the weighting factor, by which the look-up table output for the next higher input is weighted. Thus, for a small difference between the determined direction and the next lower input, the output of the look-up table for the next lower input would be weighted with a higher weighting factor compared to a weighting factor used for weighting an output of the look-up table corresponding to the next higher look-up table input for the direction of the sound.

Subsequently, FIGS. 1D to 1G are discussed for showing examples for the specific calculation of the different blocks in more detail.

Figure 1D:
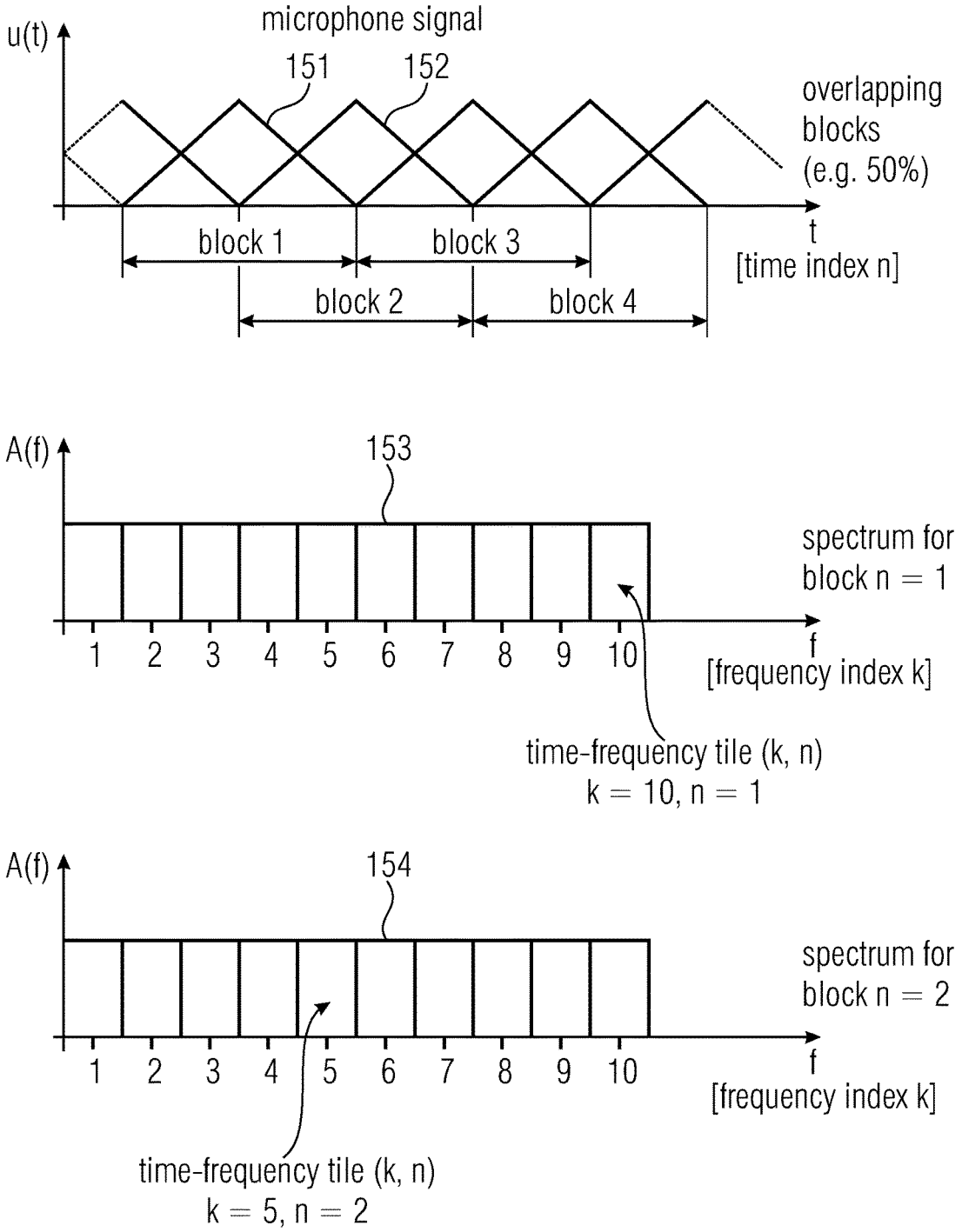
FIG. 1D illustrates the time-frequency conversion of an exemplary microphone signal where specific time-frequency tiles (10, 1) for a frequency bin 10 and time block 1 on the one hand and (5, 2) for a frequency bin 5 and time block 2 are specifically identified.

The upper illustration in FIG. 1D shows a schematic microphone signal. However, the actual amplitude of the microphone signal is not illustrated. Instead, windows are illustrated and, particularly, windows 151 and 152. Window 151 defines a first block 1 and window 152 identifies and determines a second block 2. Thus, a microphone signal is processed with advantageously overlapping blocks where the overlap is equal to 50%. However, a higher or lower overlap could be used as well, and even no overlap at all would be feasible. However, an overlap processing is performed in order to avoid blocking artifacts.

Each block of sampling values of the microphone signal is converted into a spectral representation. The spectral representation or spectrum for the block with the time index n=1, i.e., for block 151, is illustrated in the middle representation in FIG. 1D, and the spectral representation of the second block 2 corresponding to reference numeral 152 is illustrated in the lower picture in FIG. 1D. Furthermore, for exemplary reasons, each spectrum is shown to have ten frequency bins, i.e., the frequency index k extends between 1 and 10, for example.

Thus, the time-frequency tile (k, n) is the time-frequency tile (10, 1) at 153 and, a further example shows another time-frequency tile (5, 2) at 154. The further processing performed by the apparatus for generating a sound field description is, for example, illustrated in FIG. 1D, exemplarily illustrated using these time-frequency tiles indicated by reference numerals 153 and 154.

It is, furthermore, assumed that the direction determiner 102 determines a sound direction or "DOA" (direction of arrival) exemplarily indicated by the unit norm vector n. Alternative direction indications comprise an azimuth angle, an elevation angle or both angles together. To this end, all microphone signals of the plurality of the microphone signals, where each microphone signal is represented by subsequent blocks of frequency bins as illustrated in FIG. 1D, are used by the direction determiner 102, and the direction determiner 102 of FIG. 1C then determines the sound direction or DOA, for example. Thus, exemplarily, the time-frequency tile (10, 1) has the sound direction n(10, 1) and the time-frequency tile (5, 2) has the sound direction n(5, 2) as illustrated in the upper portion of FIG. 1E. In the three-dimensional case, the sound direction is a three-dimensional vector having an x, a y or a z component. Naturally, other coordinate systems such as spherical coordinates can be used as well which rely on two angles and a radius. Alternatively, the angles can be e.g. azimuth and elevation. Then, the radius is not required. Similarly, there are two components of the sound direction in a two-dimensional case such as Cartesian coordinates, i.e., an x and a y direction, but, alternatively, circular coordinates having a radius and an angle or azimuth and elevation angles can be used as well.

This procedure is not only performed for the time-frequency tiles (10, 1) and (5, 2), but for all time-frequency tiles, by which the microphone signals are represented.

Then, the one or more spatial basis functions needed are determined. Particularly, it is determined which number of the sound field components or, generally, the representation of the sound field components should be generated. The number of spatial basis functions that are now used by the spatial basis function evaluator 103 of FIG. 1C finally determines the number of sound field components for each time-frequency tile in a spectral representation or the number of sound field components in the time domain.

For the further embodiment, it is assumed that a number of four sound field components is to be determined where, exemplarily, these four sound field components can be an omnidirectional sound field component (corresponding to the order equal to 0) and three directional sound field components that are directional in the corresponding coordinate directions of the Cartesian coordinate system.

The lower illustration in FIG. 1E illustrates the evaluated spatial basis functions $G_i$ for the different time-frequency tiles. Thus, it becomes clear that, in this example, four evaluated spatial basis functions for each time-frequency tile are determined. When it is exemplarily assumed that each block has ten frequency bins, then a number of 40 evaluated spatial basis functions G, is determined for each block such as for block n=1 and for block n=2 as illustrated in FIG. 1E. Therefore, all together, when only two blocks are considered and each block has ten frequency bins, then the procedure results in 80 evaluated spatial basis functions, since there are twenty time-frequency tiles in the two blocks and each time-frequency tile has four evaluated spatial basis functions.

Figure 1F:
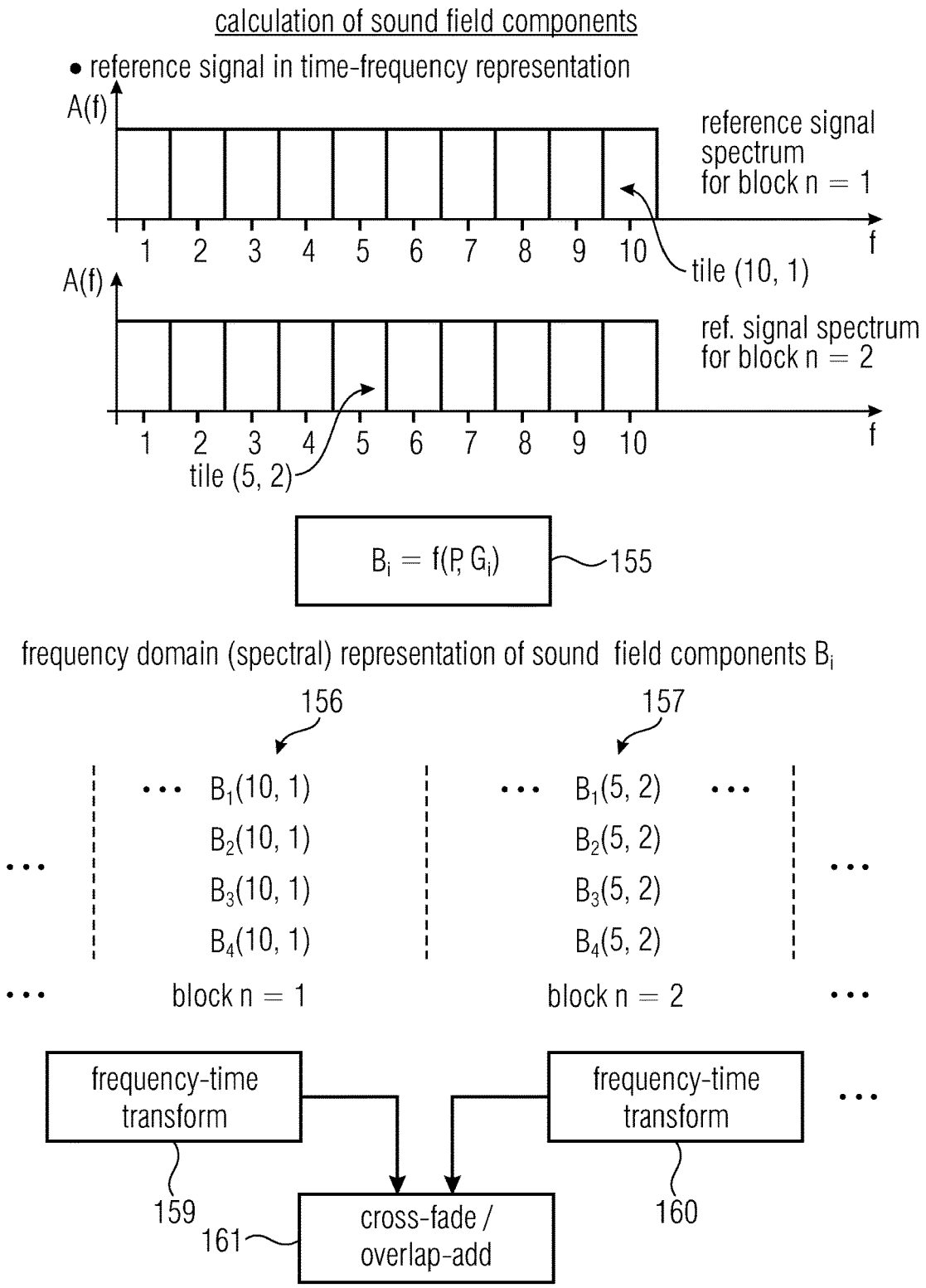
FIG. 1F illustrates the calculation of the sound field components for the two bins (10, 1) and (5, 2) and the subsequent frequency-time conversion and cross-fade/overlap-add processing.

FIG. 1F illustrates implementations of the sound field component calculator 201 of FIG. 1C. FIG. 1F illustrates in the upper two illustrations two blocks of frequency bins for the determined reference signal input into block 201 in FIG. 1C via line 134. Particularly, a reference signal which can be a specific microphone signal or a combination of the different microphone signals has been processed in the same manner as has been discussed with respect to FIG. 1D. Thus, exemplarily, the reference signal is represented by a reference spectrum for a block n=1 and a reference signal spectrum for block n=2. Thus, the reference signal is decomposed into the same time-frequency pattern as has been used for the calculation of the evaluated spatial basis functions for the time-frequency tiles output via line 133 from block 103 to block 201.

Then, the actual calculation of the sound field components is performed via a functional combination between the corresponding time-frequency tile for the reference signal P and the associated evaluated spatial basis function G, as indicated at 155. Advantageously, a functional combination represented by f( . . . ) is a multiplication illustrated at 115 in the subsequently discussed FIGS. 3A, 3B. However, other functional combinations can be used as well, as discussed before. By means of the functional combination in block 155, the one or more sound field components $B_i$ are calculated for each time-frequency tile in order to obtain the frequency domain (spectral) representation of the sound field components $B_i$ as illustrated at 156 for block n=1 and at 157 for block n=2.

Thus, exemplarily, the frequency domain representation of the sound field components $B_i$ is illustrated for time-frequency tile (10, 1) on the one hand and also for time-frequency tile (5, 2) for the second block on the other hand. However, it is once again clear that the number of sound field components $B_i$ illustrated in FIG. 1F at 156 and 157 is the same as the number of evaluated spatial basis functions illustrated at the bottom portion of FIG. 1E.

When only frequency domain sound field components are needed, the calculation is completed with the output of the blocks 156 and 157. However, in other embodiments, a time domain representation of the sound field components is needed in order to obtain a time domain representation for the first sound field component $B_1$, a further time domain representation for the second sound field component $B_2$ and so on.

To this end, the sound field components $B_1$ from frequency bin 1 to frequency bin 10 in the first block 156 are inserted into a frequency-time transfer block 159 in order to obtain a time domain representation for the first block and the first component.

Analogously, in order to determine and calculate the first component in the time domain, i.e., $b_1$ (t), the spectral sound field components $B_1$ for the second block running from frequency bin 1 to frequency bin 10 are converted into a time domain representation by a further frequency-time transform 160.

Figure 1G:
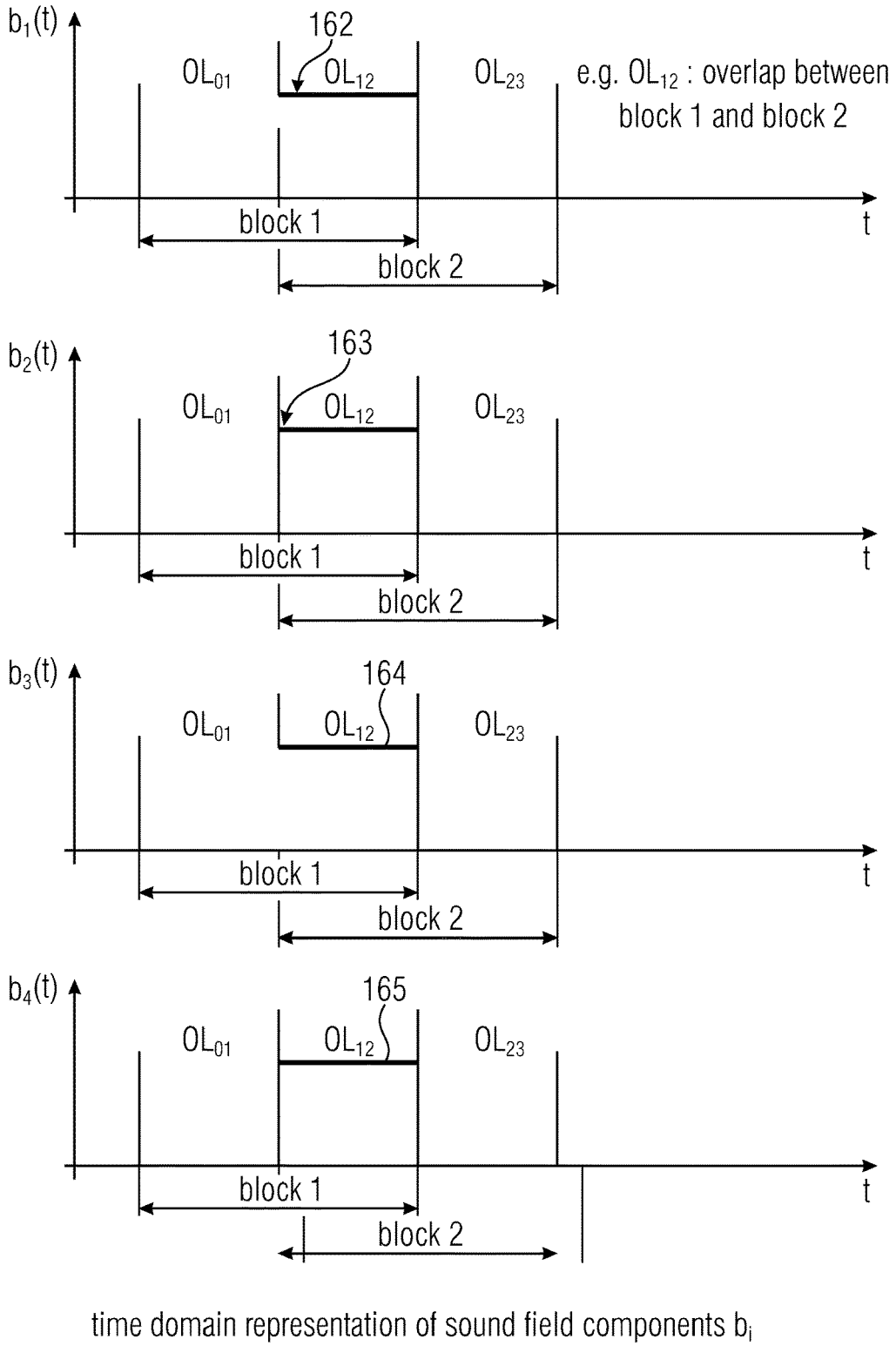
FIG. 1G illustrates a time domain representation of exemplary four sound field components $b_1$ to $b_4$ as obtained by the processing of FIG. 1F.

Due to the fact that overlapping windows were used as illustrated in the upper portion of FIG. 1D, a cross-fade or overlap-add operation 161 illustrated at the bottom in FIG. 1F can be used in order to calculate the output time domain samples of the first spectral representation $b_1$ (d) in the overlapping range between block 1 and block 2 illustrated at 162 in FIG. 1G.

The same procedure is performed in order to calculate the second time domain sound field component $b_2$ (t) within an overlap range 163 between the first block and the second block. Furthermore, in order to calculate the third sound field component $b_3$ (t) in the time domain and, particularly, in order to calculate the samples in the overlap range 164, the components $D_3$ from the first block and the components $D_3$ from the second block are correspondingly converted into a time domain representation by procedures 159, 160 and the resulting values are then cross-faded/overlap-added in block 161.

Finally, the same procedure is performed for the fourth components B4 for the first block and B4 for the second block in order to obtain the final samples of the fourth time domain representation sound field component $b_4$(t) in the overlapping range 165 as illustrated in FIG. 1G.

It is to be noted that any cross-fade/overlap-add as illustrated in block 161 is not required, when the processing, in order to obtain the time-frequency tiles, is not performed with overlapping blocks but is performed with non-overlapping blocks.

Furthermore, in case of a higher overlap where more than two blocks overlap each other, a correspondingly higher number of blocks 159, 160 is needed and the cross-fade/overlap-add of block 161 is calculated not only with two inputs but even with three inputs in order to finally obtain samples of the time domain representations illustrated in FIG. 1G.

Furthermore, it is to be noted that the samples for the time domain representations, for example, for overlap range $OL_{23}$ is obtained by applying the procedures in block 159, 160 to the second block and the third block. Correspondingly, the samples for the overlap range $OL_{0,1}$ is calculated by performing the procedures 159, 160 to the corresponding spectral sound field components $B_i$ for the certain number i for block 0 and block 1.

Furthermore, as already outlined, the representation of sound field components can be a frequency domain representation as illustrated at FIG. 1F for 156 and 157. Alternatively, the representation of the sound field components can be a time domain representation as illustrated in FIG. 1G, wherein the four sound field components represent straightforward sound signals having a sequence of samples associated with a certain sampling rate. Furthermore, either the frequency domain representation or the time domain representation of the sound field components can be encoded. This encoding can be performed separately so that each sound field component is encoded as a mono-signal, or the encoding can be performed jointly, so that, for example, the four sound field components $B_1$ to $B_4$ are considered to be a multi-channel signal having four channels. Thus, either a frequency domain encoded representation or a time domain representation being encoded with any useful encoding algorithm is also a representation of the sound field components.

Furthermore, even a representation in the time domain before the cross-fade/overlap-add performed by block 161 can be a useful representation of sound field components for a certain implementation. Furthermore, a kind of vector quantization over the blocks n for a certain component such as component 1 can also be performed in order to compress the frequency domain representation of the sound field component for transmission or storage or other processing tasks.

Advantageous Embodiments

Figure 2A:
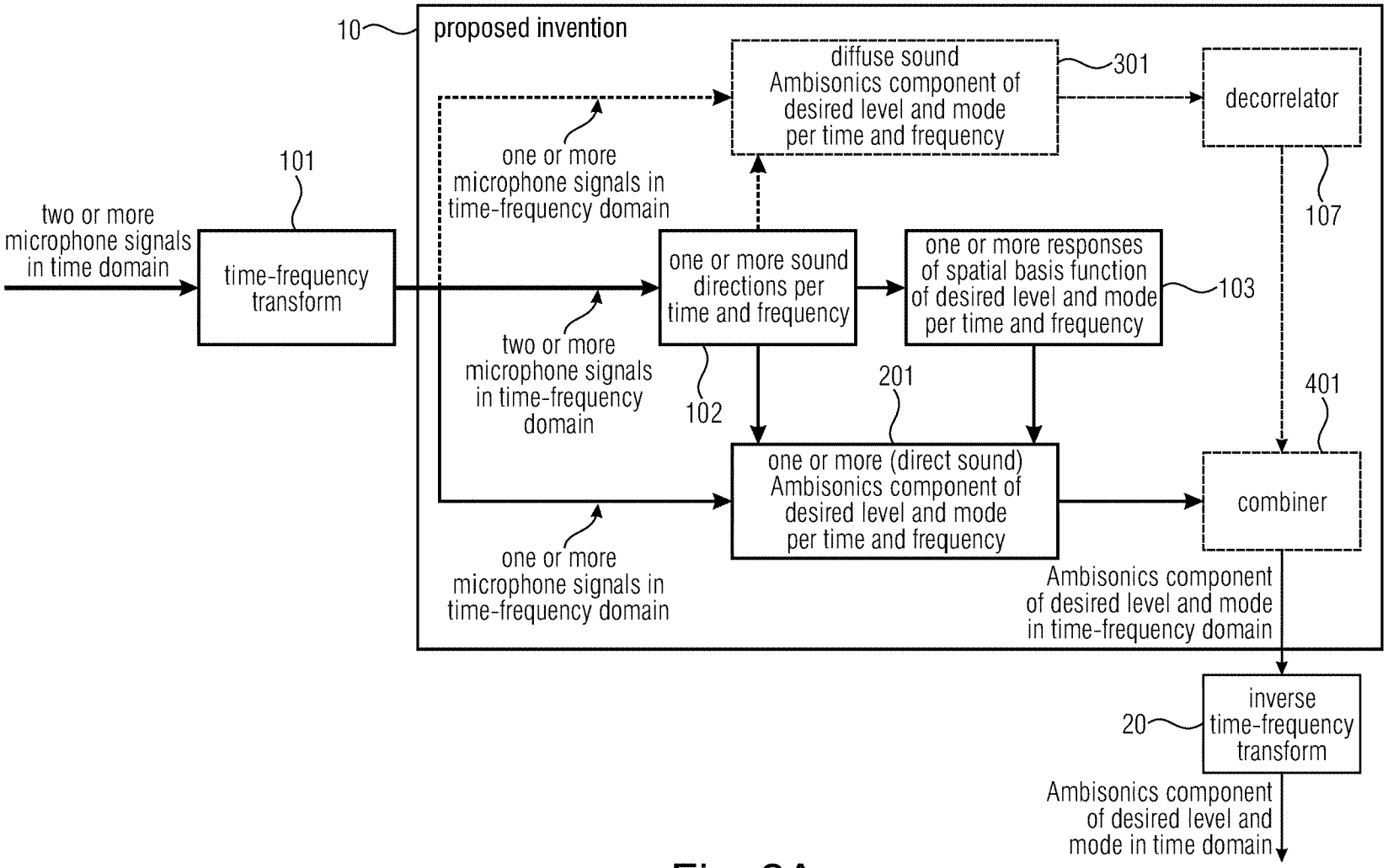
FIG. 2A shows a general block scheme of the present invention.

FIG. 2A shows the present novel approach, given by Block (10), which allows to synthesize an Ambisonics component of a desired order (level) and mode from the signals of multiple (two or more) microphones. Unlike related state-of-the-art approaches, no constraints are made for the microphone setup. This means, the multiple microphones may be arranged in an arbitrary geometry, for example, as a coincident setup, linear array, planar array, or three-dimensional array. Moreover, each microphone may possess an omnidirectional or an arbitrary directional directivity. The directivities of the different microphones can differ.

To obtain the desired Ambisonics component, the multiple microphone signals are first transformed into a time-frequency representation using Block (101). For this purpose, one can use for example a filterbank or a short-time Fourier transform (STFT). The output of Block (101) are the multiple microphone signals in the time-frequency domain. Note that the following processing is carried out separately for the time-frequency tiles.

After transforming the multiple microphone signals in the time-frequency domain, we determine one or more sound directions (for a time-frequency tile) in Block (102) from two or more microphone signals. A sound direction describes from which direction a prominent sound for a time-frequency tile is arriving at the microphone array. This direction is usually referred to as direction-of-arrival (DOA) of the sound. Alternatively to the DOA, one could also consider the propagation direction of the sound, which is the opposite direction of the DOA, or any other measure that describes the sound direction. The one or multiple sound directions or DOAs are estimated in Block (102) by using for example state-of-the-art narrowband DOA estimators, which are available for almost any microphone setup. Suitable example DOA estimators are listed in Embodiment 1. The number of sound directions or DOAs (one or more), which are computed in Block (102), depends for example on the tolerable computational complexity but also on the capabilities of the used DOA estimator or the microphone geometry. A sound direction can be estimated for example in the 2D space (represented for example in form of an azimuth angle) or in the 3D space (represented for example in form of an azimuth angle and an elevation angle). In the following, most descriptions are based on the more general 3D case, even though it is straight-forward to apply all processing steps to the 2D case as well. In many cases, the user specifies how many sound directions or DOAs (for example, 1, 2, or 3) are estimated per time-frequency tile. Alternatively, the number of prominent sounds can be estimated using state-of-the-art approaches, for example the approaches explained in [SourceNum].

The one or more sound directions, which were estimated in Block (102) for a time-frequency tile, are used in Block (103) to compute for the time-frequency tile one or more responses of a spatial basis function of the desired order (level) and mode. One response is computed for each estimated sound direction. As explained in the previous section, a spatial basis function can represent for example a spherical harmonic (for example if the processing is carried out in the 3D space) or a cylindrical harmonic (for example if the processing is carried out in the 2D space). The response of a spatial basis function is the spatial basis function evaluated at the corresponding estimated sound direction, as explained in more detail in the first embodiment.

The one or more sound directions, which are estimated for a time-frequency tile, are further used in Block (201), namely to compute for the time-frequency tile one or more Ambisonics components of the desired order (level) and mode. Such an Ambisonics component synthesizes an Ambisonics component for a directional sound arriving from the estimated sound direction. Additional input to Block (201) are the one or more responses of the spatial basis function which were computed for the time-frequency tile in Block (103), as well as one or more microphone signals for the given time-frequency tile. In Block (201) one Ambisonics components of the desired order (level) and mode is computed for each estimated sound direction and corresponding response of the spatial basis function. The processing steps of Block (201) are discussed further in the following embodiments.

The present invention (10) contains an optional Block (301) which can compute for a time-frequency tile a diffuse sound Ambisonics component of the desired order (level) and mode. This component synthesizes an Ambisonics component for example for a purely diffuse sound field or for ambient sound. Input to Block (301) are the one or more sound directions, which were estimated in Block (102), as well as one or more microphone signals. The processing steps of Block (301) are discussed further in the later embodiments.

The diffuse sound Ambisonics components, which are computed in the optional Block (301), may be further decorrelated in the optional Block (107). For this purpose, state-of-the-art decorrelators can be used. Some examples are listed in the Embodiment 4. Typically, one would apply different decorrelators or different realizations of a decorrelator for different orders (levels) and modes. In doing so, the decorrelated diffuse sound Ambisonics components of different orders (levels) and modes will be mutually uncorrelated. This mimics the expected physical behavior, namely that Ambisonics components of different orders (levels) and modes are mutually uncorrelated for diffuse sounds or ambient sounds, as explained for example in [SpCoherence].

The one or more (direct sound) Ambisonics components of the desired order (level) and mode, which were computed for a time-frequency tile in Block (201), and the corresponding diffuse sound Ambisonics component which was computed in Block (301), are combined in Block (401). As discussed in the later Embodiments, the combination can be realized for example as a (weighted) sum. The output of Block (401) is the final synthesized Ambisonics component of the desired order (level) and mode for a given time-frequency tile. Clearly, if only a single (direct sound) Ambisonics component of the desired order (level) and mode was computed in Block (201) for a time-frequency tile (and no diffuse sound Ambisonics component), then the combiner (401) is superfluous.

After computing the final Ambisonics component of the desired order (level) and mode for all time-frequency tiles, the Ambisonics component may be transformed back into the time domain with the inverse time-frequency transform (20), which can be realized for example as an inverse filterbank or an inverse STFT. Note that the inverse time-frequency transform is not required in every application, and therefore, it is no part of the present invention. In practice, one would compute the Ambisonics components for all desired orders and modes to obtain the desired Ambisonics signal of the desired maximum order (level).

Figure 2B:
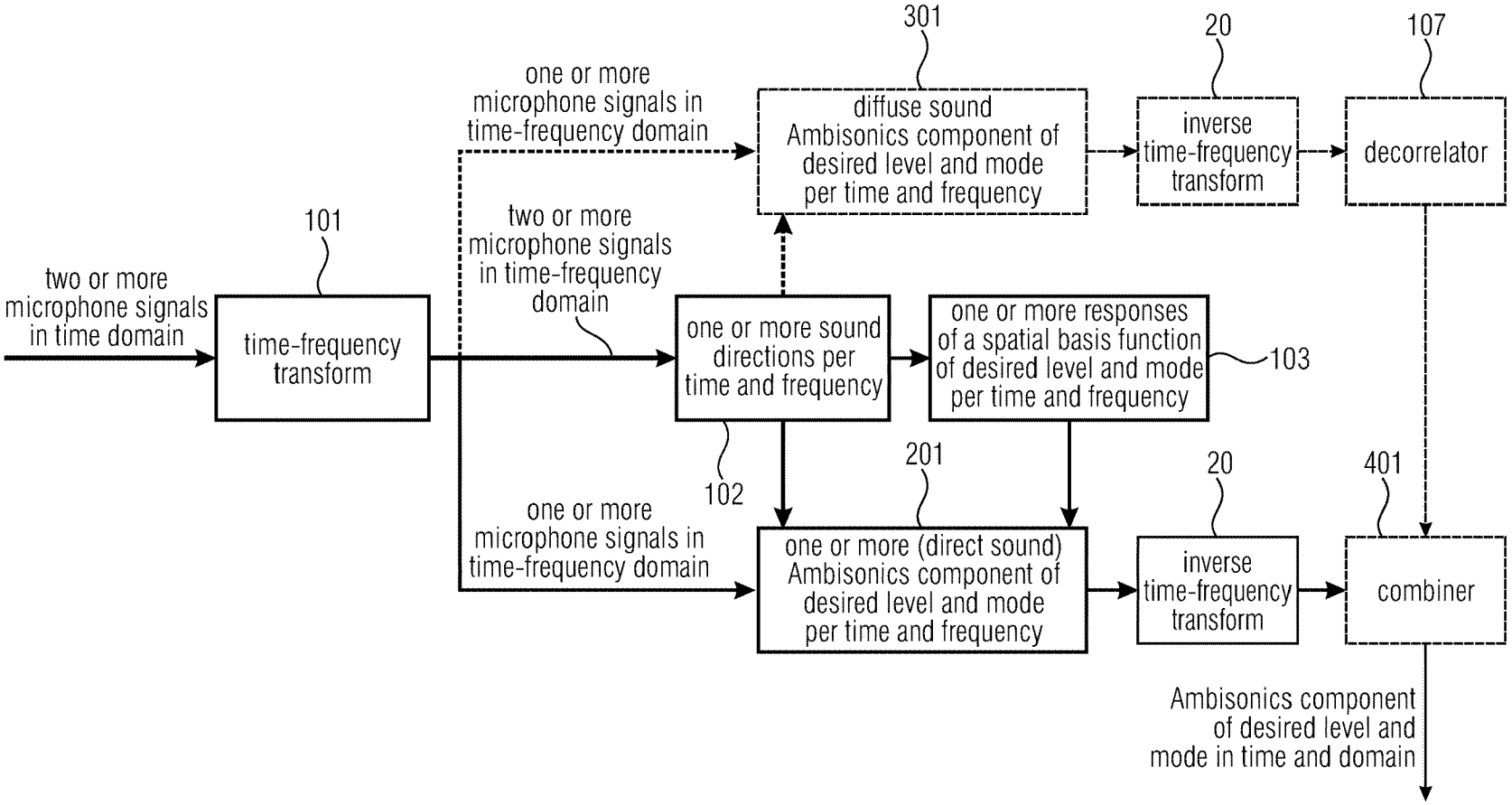
FIG. 2B shows a general block scheme of the present invention where the inverse time-frequency transform is applied before the combiner.

FIG. 2B shows a slightly modified realization of the same present invention. In this figure, the inverse time-frequency transform (20) is applied before the combiner (401). This is possible as the inverse time-frequency transform is usually a linear transformation. By applying the inverse time-frequency transform before the combiner (401), it is possible for example to carry out the decorrelation in the time domain (instead of the time-frequency domain as in FIG. 2A). This can have practical advantages for some applications when implementing the invention.

It is to be noted that the inverse filterbank can also be somewhere else. Generally, the combiner and the decorrelator should be (and the latter is usually) applied in the time domain. But, both or only one block can also be applied in the frequency domain.

Advantageous embodiments comprise, therefore, a diffuse component calculator 301 for calculating, for each time-frequency tile of the plurality of time-frequency tiles, one or more diffuse sound components. Furthermore, such embodiments comprise a combiner 401 for combining diffuse sound information and direct sound field information to obtain a frequency domain representation or a time domain representation of the sound field components. Furthermore, depending on the implementation, the diffuse component calculator further comprises a decorrelator 107 for decorrelating the diffuse sound information, wherein the decorrelator can be implemented within the frequency domain so that the correlation is performed with the time-frequency tile representation of the diffuse sound component. Alternatively, the decorrelator is configured to operate within the time domain as illustrated in FIG. 2B so that a decorrelation within the time domain of the time-representation of a certain diffuse sound component of a certain order is performed.

Further embodiments relating to the present invention comprise a time-frequency converter such as the time-frequency converter 101 for converting each of a plurality of time domain microphone signals into a frequency representation having the plurality of time-frequency tiles. Further embodiments comprise frequency-time converters such as block 20 of FIG. 2A or FIG. 2B for converting the one or more sound field components or a combination of the one or more sound field components, i.e., the direct sound field components and diffuse sound components into a time domain representation of the sound field component.

In particular, the frequency-time converter 20 is configured to process the one or more sound field components to obtain a plurality of time domain sound field components where these time domain sound field components are the direct sound field components. Furthermore, the frequency-time converter 20 is configured to process the diffuse sound (field) components to obtain a plurality of time domain diffuse (sound field) components and the combiner is configured to perform the combination of the time domain (direct) sound field components and the time domain diffuse (sound field components) in the time domain as illustrated, for example, in FIG. 2B. Alternatively, the combiner 401 is configured to combine the one or more (direct) sound field components for a time-frequency tile and the diffuse sound (field) components for the corresponding time-frequency tile within the frequency domain, and the frequency-time converter 20 is then configured to process a result of the combiner 401 to obtain the sound field components in the time domain, i.e., the representation of the sound field components in the time domain as, for example, illustrated in FIG. 2A.

The following embodiments describe in more detail several realizations of the present invention. Note that the Embodiments 1-7 consider one sound direction per time-frequency tile (and thus, only one response of a spatial basis function and only one direct sound Ambisonics component per level and mode and time and frequency). Embodiment 8 describes an example where more than one sound direction is considered per time-frequency tile. The concept of this embodiment can be applied in a straightforward manner to all other embodiments.

Embodiment 1

Figure 3A:
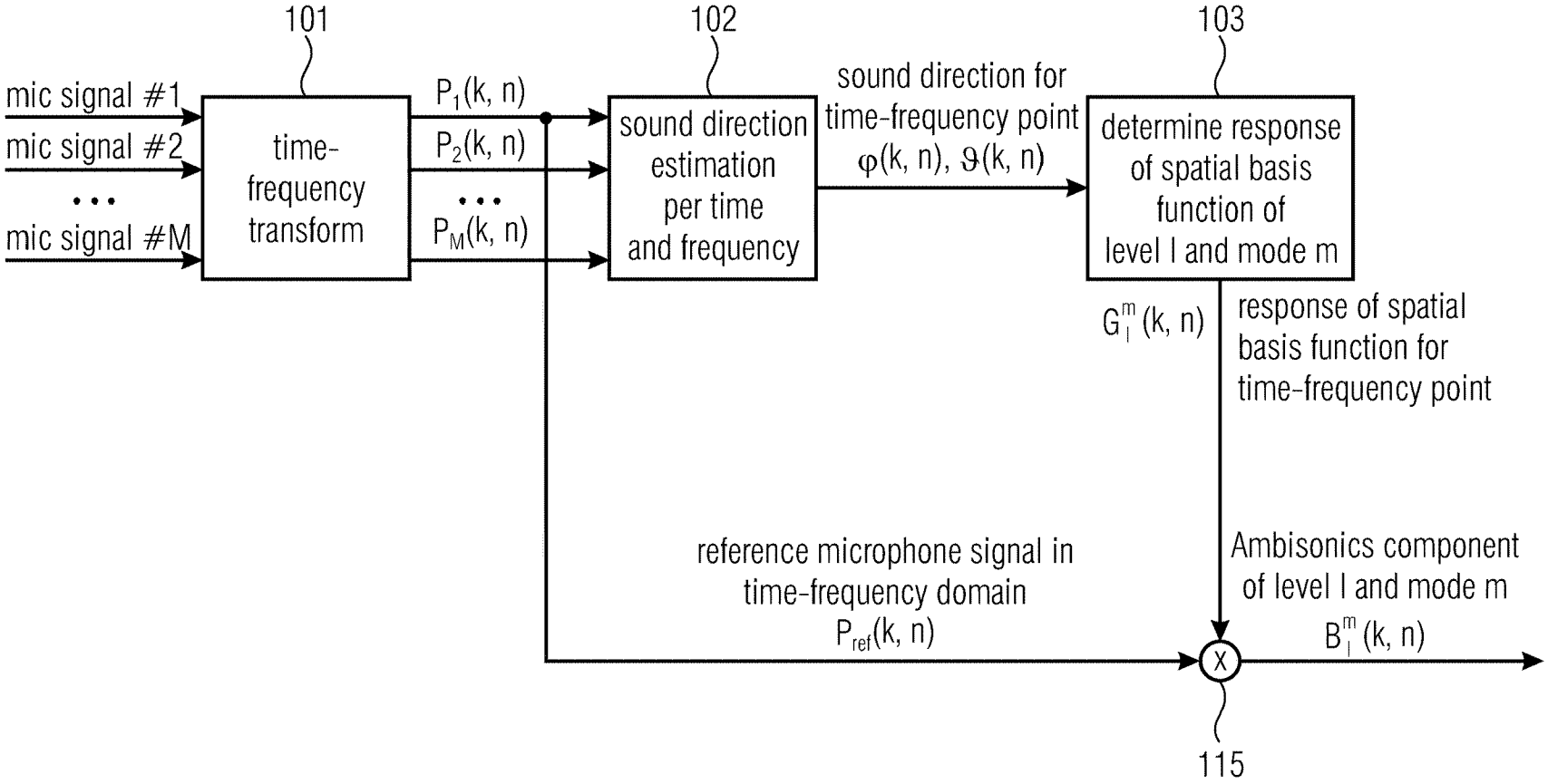
FIG. 3A shows an embodiment of the invention where an Ambisonics component of a desired level and mode is calculated from a reference microphone signal and sound direction information.

FIG. 3A shows an embodiment of the invention which allows to synthesize an Ambisonics component of a desired order (level) l and mode m from the signals of multiple (two or more) microphones.

Input to the invention are the signals of multiple (two or more) microphones. The microphones may be arranged in an arbitrary geometry, for example, as a coincident setup, linear array, planar array, or three-dimensional array. Moreover, each microphone may possess an omnidirectional or an arbitrary directional directivity. The directivities of the different microphones can differ.

The multiple microphone signals are transformed into the time-frequency domain in Block (101) using for example a filterbank or a short-time Fourier transform (STFT). Output of the time-frequency transform (101) are the multiple microphone signals in the time-frequency domain, which are denoted by $P_{1 \ldots M}(k, n)$, where k is the frequency index, n is the time index, and M is the number of microphones. Note that the following processing is carried out separately for the time-frequency tiles (k, n).

After transforming the microphone signals into the time-frequency domain, a sound direction estimation is carried out in Block (102) per time and frequency using two or more of the microphone signals $P_{1 \ldots M}(k, n)$. In this embodiment, a single sound direction is determined per time and frequency. For the sound direction estimation in (102) state-of-the-art narrowband direction-of-arrival (DOA) estimators may be used, which are available in literature for different microphone array geometries. For example, the MUSIC algorithm [MUSIC] can be used which is applicable to arbitrary microphone setups. In case of uniform linear arrays, non-uniform linear arrays with equidistant grid points, or circular arrays of omnidirectional microphones, the Root MUSIC algorithm [RootMUSIC1,RootMUSIC2, RootMUSIC3] can be applied which is computationally more efficient than MUSIC. Another well-known narrowband DOA estimator, which can be applied to linear arrays or planar arrays with rotationally invariant subarray structure is ESPRIT [ESPRIT].

In this embodiment, the output of the sound direction estimator (102) is a sound direction for a time instance n and frequency index k. The sound direction can be expressed for example in terms of a unit-norm vector n(k, n) or in terms of an azimuth angle φ(k, n) and/or elevation angle ϑ(k, n), which are related for example as $$n(k, n) = \begin{bmatrix} \cos \varphi(k, n) \cos \vartheta(k, n) \\ \sin \varphi(k, n) \cos \vartheta(k, n) \\ \sin \vartheta(k, n) \end{bmatrix}.$$

If no elevation angle ϑ(k, n) is estimated (2D case), we can assume zero elevation, i.e., ϑ(k, n)=0, in the following steps. In this case, the unit-norm vector n(k, n) can be written as $$n(k, n) = \begin{bmatrix} \cos \varphi(k, n) \\ \sin \varphi(k, n) \end{bmatrix}.$$

After estimating the sound direction in Block (102), a response of a spatial basis function of the desired order (level) l and mode m is determined in Block (103) individually per time and frequency using the estimated sound direction information. The response of a spatial basis function of order (level) l and mode m is denoted by $G_l^m(k, n)$ and is calculated as $$G_l^m(k,n)=Y_l^m(\varphi,\vartheta).$$

Here, $Y_l^m(\varphi, \vartheta)$ is a spatial basis function of order (level) l and mode m which depends on the direction indicated by the vector n(k, n) or the azimuth angle φ(k, n) and/or elevation angle ϑ(k, n). Therefore, the response $G_l^m(k, n)$ describes the response of a spatial basis function $Y_l^m(\varphi, \vartheta)$ for a sound arriving from the direction indicated by the vector n(k, n) or the azimuth angle φ(k, n) and/or elevation angle ϑ(k, n). For example, when considering real-valued spherical harmonics with N3D normalization as spatial basis function, $Y_l^m(\varphi, \vartheta)$ can be calculated as [SphHarm, Ambix, FourierAcoust]

$$Y_l^m(\varphi, \vartheta) = \begin{cases} \sqrt{2}\, K_l^m \cos(m\varphi) L_l^m(\cos \vartheta) \text{ if } m > 0 \\ K_l^m L_l^m(\cos \vartheta) \text{ if } m = 0 \\ \sqrt{2}\, K_l^m \sin(-m\varphi) L_l^{-m}(\cos \vartheta) \text{ if } m < 0 \end{cases}$$

where $$K_l^m = \sqrt{\frac{(2l+1)}{4\pi} \frac{(l-|m|)!}{(l+|m|)!}}$$

are the N3D normalization constants and $L_l^m(\cos \vartheta)$ is the associated Legendre polynomial of order (level) l and mode m depending on the elevation angle, which is defined for example in [FourierAcoust]. Note that the response of the spatial basis function $Y_l^m(k, n)$ of the desired order (level) l and mode m can also be pre-computed for each azimuth and/or elevation angle and stored in a lookup table and then be selected depending on the estimated sound direction.

In this embodiment, without loss of generality, the first microphone signal is referred to as the reference microphone signal $P_{ref}(k, n)$, i.e., $$P_{ref}(k,n)=P_1(k,n).$$

In this embodiment, the reference microphone signal $P_{ref}(k, n)$ is combined such as multiplied 115 for the time-frequency tile (k, n) with the response $G_l^m(k, n)$ of the spatial basis function determined in Block (103), i.e., $$B_1^m(k,n)=P_{ref}(k,n)G_l^m(k,n),$$

resulting in the desired Ambisonics component $B_l^m(k, n)$ of order (level) l and mode m for the time-frequency tile (k, n). The resulting Ambisonics components $B_l^m(k, n)$ eventually may be transformed back into the time domain using an inverse filterbank or an inverse STFT, stored, transmitted, or used for example for spatial sound reproduction applications. In practice, one would compute the Ambisonics components for all desired orders and modes to obtain the desired Ambisonics signal of the desired maximum order (level).

Embodiment 2

Figure 3B:
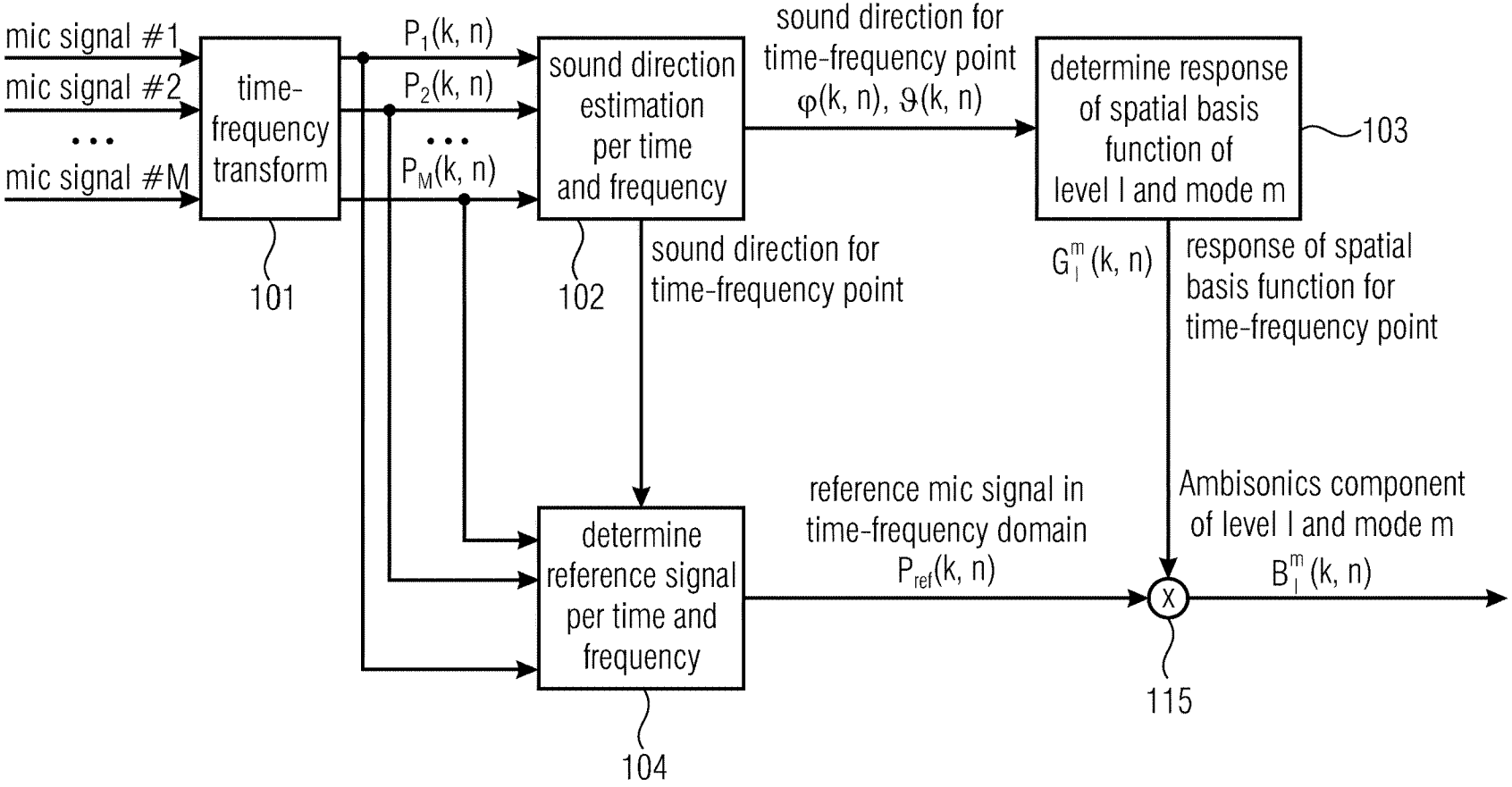
FIG. 3B shows an embodiment of the invention where the reference microphone is selected based on direction-of-arrival information.

FIG. 3B shows another embodiment of the invention which allows to synthesize an Ambisonics component of a desired order (level) l and mode m from the signals of multiple (two or more) microphones. The embodiment is similar to Embodiment 1 but additionally contains a Block (104) to determine the reference microphone signal from the plurality of microphone signals.

As in Embodiment 1, input to the invention are the signals of multiple (two or more) microphones. The microphones may be arranged in an arbitrary geometry, for example, as a coincident setup, linear array, planar array, or three-dimensional array. Moreover, each microphone may possess an omnidirectional or an arbitrary directional directivity. The directivities of the different microphones can differ.

As in Embodiment 1, the multiple microphone signals are transformed into the time-frequency domain in Block (101) using for example a filterbank or a short-time Fourier transform (STFT). Output of the time-frequency transform (101) are the microphone signals in the time-frequency domain, which are denoted by $P_{1 \ldots M}(k, n)$. The following processing is carried out separately for the time-frequency tiles (k, n).

As in Embodiment 1, a sound direction estimation is carried out in Block (102) per time and frequency using two or more of the microphone signals $P_{1 \ldots M}(k, n)$. Corresponding estimators are discussed in Embodiment 1. The output of the sound direction estimator (102) is a sound direction per time instance n and frequency index k. The sound direction can be expressed for example in terms of a unit-norm vector n(k, n) or in terms of an azimuth angle φ(k, n) and/or elevation angle ϑ(k, n), which are related as explained in Embodiment 1.

As in Embodiment 1, the response of a spatial basis function of the desired order (level) l and mode m is determined in Block (103) per time and frequency using the estimated sound direction information. The response of the spatial basis function is denoted by $G_l^m(k, n)$. For example, we can consider real-valued spherical harmonics with N3D normalization as spatial basis function and $G_l^m(k, n)$ can be determined as explained in Embodiment 1.

In this Embodiment, a reference microphone signal $P_{ref}(k, n)$ is determined from the multiple microphone signals $P_{1 \ldots M}(k, n)$ in Block (104). For this purpose, Block (104) uses the sound direction information which was estimated in Block (102). Different reference microphones signals may be determined for different time-frequency tiles. Different possibilities exist to determine the reference microphone signal $P_{ref}(k, n)$ from the multiple microphone signals $P_{1 \ldots M}(k, n)$ based on the sound direction information. For example, one can select per time and frequency the microphone from the multiple microphones which is closest to the estimated sound direction. This approach is visualized in FIG. 1B. For example, assuming that the microphone positions are given by the position vectors $d_{1 \ldots M}$, the index i(k, n) of the closest microphone can be found by solving the problem $$i(k, n) = \arg \min_{j \in [1,M]} \|d_j - n(k, n)\|$$

such that the reference microphone signal for the considered time and frequency is given by $$P_{ref}(k,n)=P_{i(k,n)}(k,n).$$

In the example in FIG. 1B, the reference microphone for the time-frequency tile (k, n) would be microphone number 3, i.e., i(k, n)=3, as $d_3$ is closes to n(k, n). An alternative approach to determine the reference microphone signal $P_{ref}(k, n)$ is to apply a multi-channel filter to the microphone signals, i.e., $$P_{ref}(k,n)=w^H(n)p(k,n),$$

where w(n) is the multi-channel filter which depends on the estimated sound direction and the vector p(k, n)=(k, n)=$[P_1(k, n) \ldots, P_M(k, n)]^T$ contains the multiple microphone signals. There exist many different optimal multi-channel filters w(n) in literature which can be used to compute $P_{ref}(k, n)$, for example the delay&sum filter or the LCMV filter, which are derived for example in [OptArrayPr]. Using multi-channel filters provides different advantages and disadvantages which are explained in [OptArrayPr], for example, they allow us to reduce the microphone self-noise.

As in Embodiment 1, the reference microphone signal $P_{ref}(k, n)$ finally is combined such as multiplied 115 per time and frequency with the response $G_l^m(k, n)$ of the spatial basis function determined in Block (103) resulting in the desired Ambisonics component $B_l^m(k, n)$ of order (level) l and mode m for the time-frequency tile (k, n). The resulting Ambisonics components $B_l^m(k, n)$ eventually may be transformed back into the time domain using an inverse filterbank or an inverse STFT, stored, transmitted, or used for example for spatial sound reproduction. In practice, one would compute the Ambisonics components for all desired orders and modes to obtain the desired Ambisonics signal of the desired maximum order (level).

Embodiment 3

Figure 4:
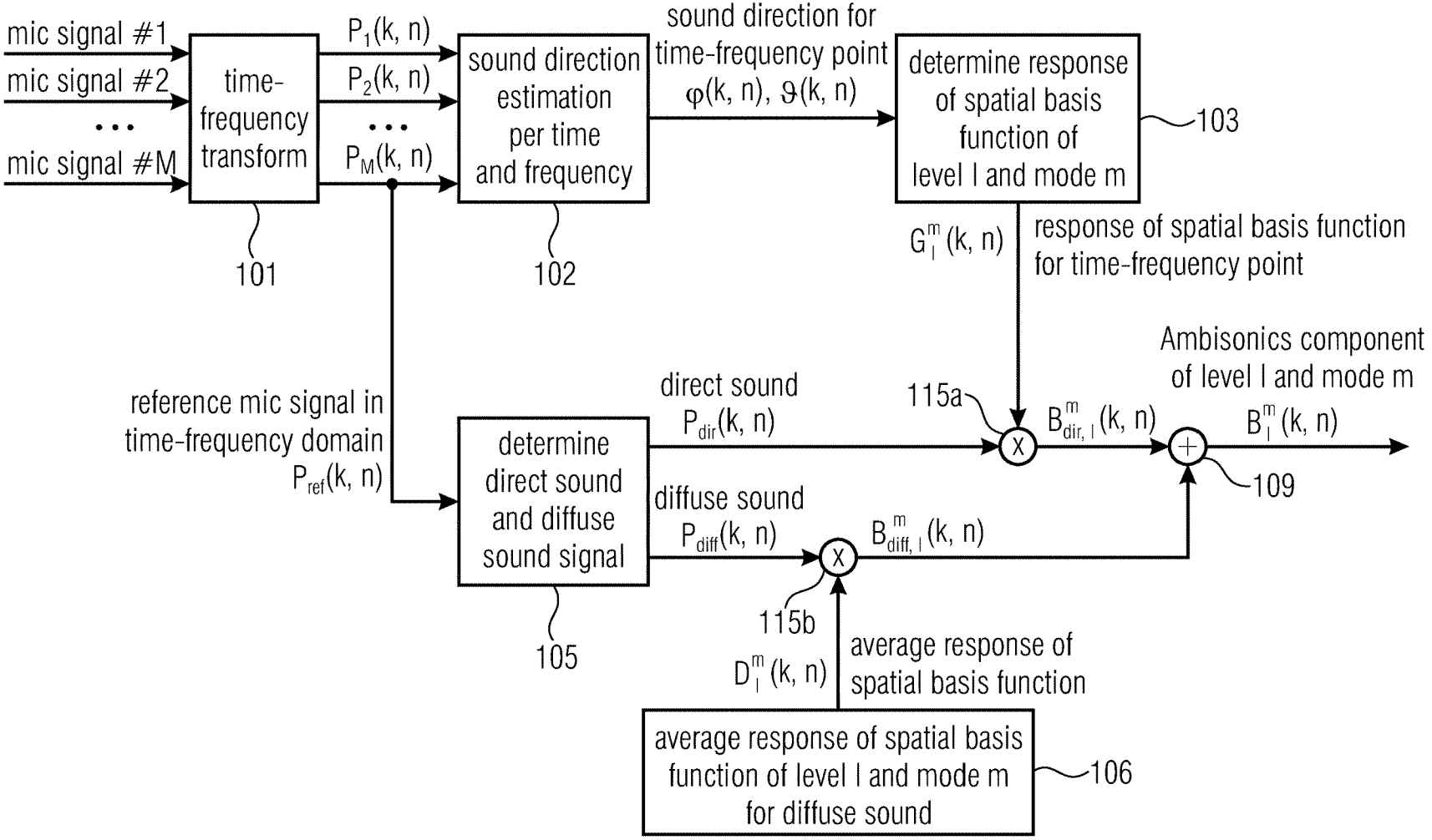
FIG. 4 shows an embodiment of the invention where a direct sound Ambisonics component and a diffuse sound Ambisonics component is calculated.

FIG. 4 shows another embodiment of the invention which allows to synthesize an Ambisonics component of a desired order (level) l and mode m from the signals of multiple (two or more) microphones. The embodiment is similar to Embodiment 1 but computes the Ambisonics components for a direct sound signal and a diffuse sound signal.

As in Embodiment 1, input to the invention are the signals of multiple (two or more) microphones. The microphones may be arranged in an arbitrary geometry, for example, as a coincident setup, linear array, planar array, or three-dimensional array. Moreover, each microphone may possess an omnidirectional or an arbitrary directional directivity. The directivities of the different microphones can differ.

As in Embodiment 1, the multiple microphone signals are transformed into the time-frequency domain in Block (101) using for example a filterbank or a short-time Fourier transform (STFT). Output of the time-frequency transform (101) are the microphone signals in the time-frequency domain, which are denoted by $P_{1 \ldots M}(k, n)$. The following processing is carried out separately for the time-frequency tiles (k, n).

As in Embodiment 1, a sound direction estimation is carried out in Block (102) per time and frequency using two or more of the microphone signals $P_{1 \ldots M}(k, n)$. Corresponding estimators are discussed in Embodiment 1. The output of the sound direction estimator (102) is a sound direction per time instance n and frequency index k. The sound direction can be expressed for example in terms of a unit-norm vector n(k, n) or in terms of an azimuth angle φ(k, n) and/or elevation angle ϑ(k, n), which are related as explained in Embodiment 1.

As in Embodiment 1, the response of a spatial basis function of the desired order (level) l and mode m is determined in Block (103) per time and frequency using the estimated sound direction information. The response of the spatial basis function is denoted by $G_l^m(k, n)$. For example, we can consider real-valued spherical harmonics with N3D normalization as spatial basis function and $G_l^m(k, n)$ can be determined as explained in Embodiment 1.

In this embodiment, an average response of a spatial basis function of the desired order (level) l and mode m, which is independent of the time index n, is obtained from Block (106). This average response is denoted by $D_l^m(k)$ and describes the response of a spatial basis function for sounds arriving from all possible directions (such as diffuse sounds or ambient sounds). One example to define the average response $D_l^m(k)$ is to consider the integral of the squared magnitude of the spatial basis function $Y_l^m(\varphi, \vartheta)$ over all possible angles φ and/or ϑ. For example, when integrating over all angles on a sphere, we obtain $$D_l^m(k) = \int_0^{2\pi}\int_0^{\pi} |Y_l^m(\varphi, \vartheta)|^2 \sin\vartheta \, d\vartheta d\varphi.$$

Such a definition of the average response $D_l^m(k)$ can be interpreted as follows: As explained in Embodiment 1, the spatial basis function $Y_l^m(\varphi, \vartheta)$ can be interpreted as the directivity of a microphone of order l. For increasing orders, such a microphone would become more and more directive, and therefore, less diffuse sound energy or ambient sound energy would be captured in a practical sound field compared to an omnidirectional microphone (microphone of order l=0). With the definition of $D_l^m(k)$ given above, the average response $D_l^m(k)$ would result in a real-valued factor which describes by how much the diffuse sound energy or ambient sound energy is attenuated in the signal of a microphone of order/compared to an omnidirectional microphone. Clearly, besides integrating the squared magnitude of the spatial basis function $Y_l^m(\varphi, \vartheta)$ over the directions of a sphere, different alternatives exist to define the average response Din(k), for example: integrating the squared magnitude of $Y_l^m(\varphi, \vartheta)$ over the directions on a circle, integrating the squared magnitude of $Y_l^m(\varphi, \vartheta)$ over any set of desired directions (φ, ϑ), averaging the squared magnitude of $Y_l^m(\varphi, \vartheta)$ over any set of desired directions (φ, ϑ), integrating or averaging the magnitude of $Y_l^m(\varphi, \vartheta)$ instead of the squared magnitude, considering a weighted sum of $Y_l^m(\varphi, \vartheta)$ over any set of desired directions (φ, ϑ), or specifying any desired real-valued number for $D_l^m(k)$ which corresponds to the desired sensitivity of the aforementioned imagined microphone of order/with respect to diffuse sounds or ambient sounds.

The average spatial basis function response can also be pre-calculated and stored in a look up table and the determination of the response values is performed by accessing the look up table and retrieving the corresponding value.

As in Embodiment 1, without loss of generality, the first microphone signal is referred to as the reference microphone signal, i.e., $P_{ref}(k, n)=P_1(k, n)$.

In this embodiment, the reference microphone signal $P_{ref}(k, n)$ is used in Block (105) to calculate a direct sound signal denoted by $P_{dir}(k, n)$ and a diffuse sound signal denoted by $P_{diff}(k, n)$. In Block (105), the direct sound signal $P_{dir}(k, n)$ can be calculated for example by applying a single-channel filter $W_{dir}(k, n)$ to the reference microphone signal, i.e., $$P_{dir}(k,n)=W_{dir}(k,n)P_{ref}(k,n).$$

There exist different possibilities in literature to compute an optimal single-channel filter $W_{dir}(k, n)$. For example, the well-known square-root Wiener filter can be used, which was defined for example in [Victaulic] as $$W_{dir}(k, n) = \sqrt{\frac{SDR(k, n)}{SDR(k, n) + 1}}$$

where SDR(k, n) is the signal-to-diffuse ratio (SDR) at time instance n and frequency index k which describes the power ratio between the direct sound and diffuse sound as discussed in [VirtualMic]. The SDR can be estimated using any two microphones of the multiple microphone signals $P_{1 \ldots M}(k, n)$ with a state-of-the-art SDR estimator available in literature, for example the estimators proposed in [SDRestim] which are based on the spatial coherence between two arbitrary microphone signals. In Block (105), the diffuse sound signal $P_{diff}(k, n)$ can be calculated for example by applying a single-channel filter $W_{diff}(k, n)$ to the reference microphone signal, i.e., $$P_{diff}(k,n)=W_{diff}(k,n)P_{ref}(k,n).$$

There exist different possibilities in literature to compute an optimal single-channel filter $W_{diff}(k, n)$. For example, the well-known square-root Wiener filter can be used, which was defined for example in [VirtualMic] as $$W_{diff}(k, n) = \sqrt{\frac{1}{SDR(k, n) + 1}}$$

where SD R(k, n) is the SDR which can be estimated as discussed before.

In this embodiment, the direct sound signal $P_{dir}(k, n)$ determined in Block (105) is combined such as multiplied 115*a* per time and frequency with the response $G_l^m(k, n)$ of the spatial basis function determined in Block (103), i.e., $$B_{dir,l}^m(k,n)=P_{dir}(k,n)G_l^m(k,n),$$

resulting in a direct sound Ambisonics component $B_{dir,l}^m(k, n)$ of order (level) l and mode m for the time-frequency tile (k, n). Moreover, the diffuse sound signal $P_{diff}(k, n)$ determined in Block (105) is combined such as multiplied 115*b* per time and frequency with the average response $D_l^m(k)$ of the spatial basis function determined in Block (106), i.e., $$B_{diff,l}^m(k,n)=P_{diff}(k,n)D_l^m(k),$$

resulting in a diffuse sound Ambisonics component $B_{diff,l}^m(k, n)$ of order (level) l and mode m for the time-frequency tile (k, n).

Finally, the direct sound Ambisonics component $B_{dir,l}^m(k, n)$ and the diffuse sound Ambisonics component $B_{diff,l}^m(k, n)$ are combined, for example, via the summation operation (109), to obtain the final Ambisonics component $B_l^m(k, n)$ of the desired order (level) l and mode m for the time-frequency tile (k, n), i.e., $$B_l^m(k,n)=B_{dir,l}^m(k,n)+B_{diff,l}^m(k,n).$$

The resulting Ambisonics components $B_l^m(k, n)$ eventually may be transformed back into the time domain using an inverse filterbank or an inverse STFT, stored, transmitted, or used for example for spatial sound reproduction. In practice, one would compute the Ambisonics components for all desired orders and modes to obtain the desired Ambisonics signal of the desired maximum order (level).

It is important to emphasize that the transformation back into the time domain using for example an inverse filterbank or an inverse STFT may be carried out before computing $B_l^m(k, n)$, i.e, before the operation (109). This means, we first may transform $B_{dir,l}^m(k, n)$ and $B_{diff,l}^m(k, n)$ back into the time domain and then sum both components with the operation (109) to obtain the final Ambisonics component $B_l^m$. This is possible since the inverse filterbank or inverse STFT are in general linear operations.

Note that the algorithm in this embodiment can be configured such that the direct sound Ambisonics components $B_{dir,l}^m(k, n)$ and diffuse sound Ambisonics component $B_{diff,l}^m(k, n)$ are computed for different modes (orders) l. For example, $B_{dir,l}^m(k, n)$ may be computed up to order l=4 whereas $B_{diff,l}^m(k, n)$ may be computed only up to order l=1 (in this case, $B_{diff,l}^m(k, n)$ would be zero for orders larger l=1). This has specific advantages as explained in Embodiment 4. If it is desired for example to calculate only $B_{dir,l}^m(k, n)$ but not $B_{diff,l}^m(k, n)$ for a specific order (level) l or mode m, then for example Block (105) can be configured such that the diffuse sound signal $P_{diff}(k, n)$ becomes equal to zero. This can be achieved for example by setting the filter $W_{diff}(k, n)$ in the equations before to 0 and the filter $W_{dir}(k, n)$ to 1. Alternatively, one could manually set the SDR in the previous equations to a very high value.

Embodiment 4

Figure 5:
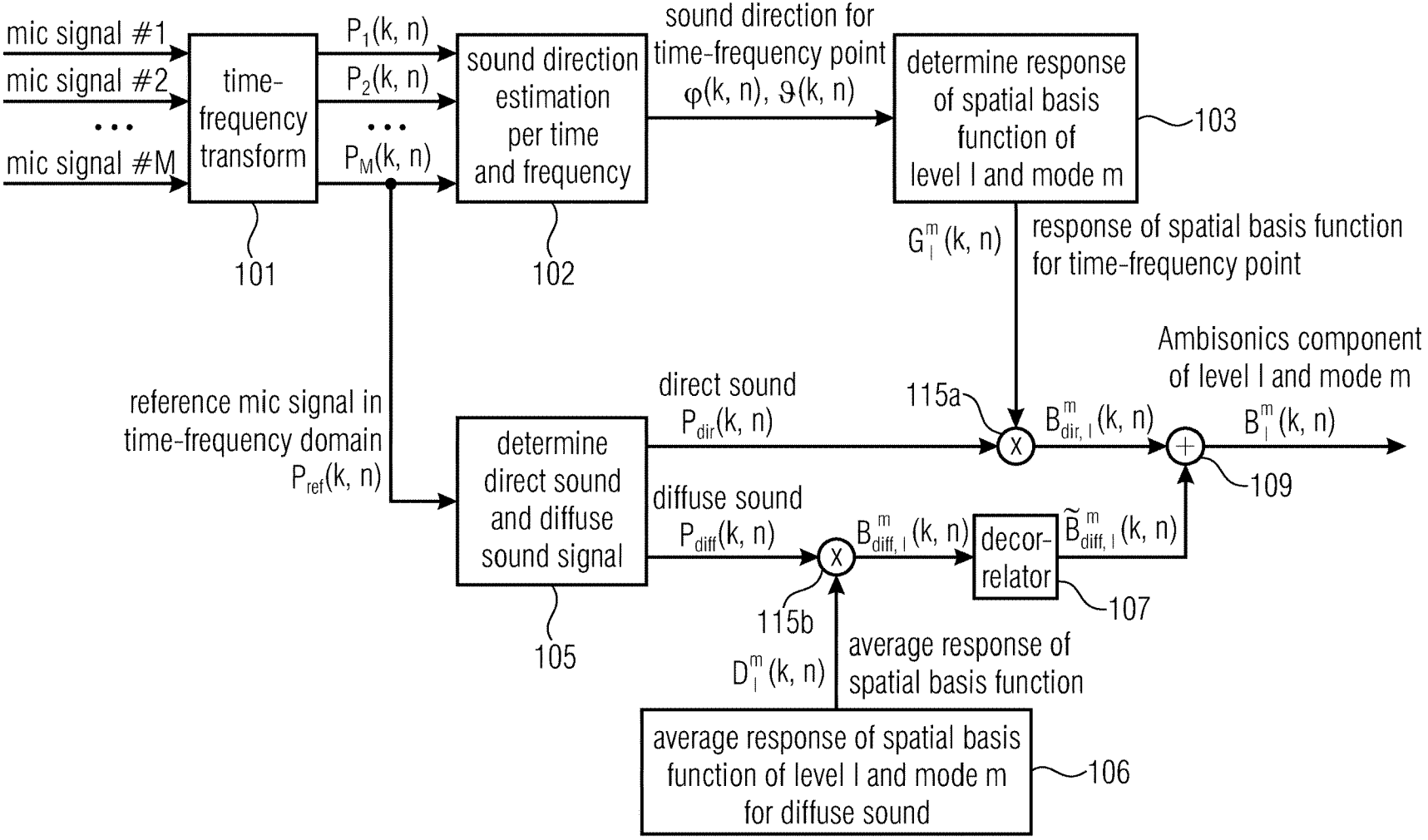
FIG. 5 shows an embodiment of the invention where the diffuse sound Ambisonics component is decorrelated.

FIG. 5 shows another embodiment of the invention which allows to synthesize an Ambisonics component of a desired order (level) l and mode m from the signals of multiple (two or more) microphones. The embodiment is similar to Embodiment 3 but additionally contains decorrelators for the diffuse Ambisonics components.

As in Embodiment 3, input to the invention are the signals of multiple (two or more) microphones. The microphones may be arranged in an arbitrary geometry, for example, as a coincident setup, linear array, planar array, or three-dimensional array. Moreover, each microphone may possess an omnidirectional or an arbitrary directional directivity. The directivities of the different microphones can differ.

As in Embodiment 3, the multiple microphone signals are transformed into the time-frequency domain in Block (101) using for example a filterbank or a short-time Fourier transform (STFT). Output of the time-frequency transform (101) are the microphone signals in the time-frequency domain, which are denoted by $P_{1 \ldots M}(k, n)$. The following processing is carried out separately for the time-frequency tiles (k, n).

As in Embodiment 3, a sound direction estimation is carried out in Block (102) per time and frequency using two or more of the microphone signals $P_{1 \ldots M}(k, n)$. Corresponding estimators are discussed in Embodiment 1. The output of the sound direction estimator (102) is a sound direction per time instance n and frequency index k. The sound direction can be expressed for example in terms of a unit-norm vector n(k, n) or in terms of an azimuth angle φ(k, n) and/or elevation angle ϑ(k, n), which are related as explained in Embodiment 1.

As in Embodiment 3, the response of a spatial basis function of the desired order (level) l and mode m is determined in Block (103) per time and frequency using the estimated sound direction information. The response of the spatial basis function is denoted by $G_l^m(k, n)$. For example, we can consider real-valued spherical harmonics with N3D normalization as spatial basis function and $G_l^m(k, n)$ can be determined as explained in Embodiment 1.

As in Embodiment 3, an average response of a spatial basis function of the desired order (level) l and mode m, which is independent of the time index n, is obtained from Block (106). This average response is denoted by $D_l^m(k)$ and describes the response of a spatial basis function for sounds arriving from all possible directions (such as diffuse sounds or ambient sounds). The average response $D_l^m(k)$ can be obtained as described in Embodiment 3.

As in Embodiment 3, without loss of generality, the first microphone signal is referred to as the reference microphone signal, i.e., $P_{ref}(k, n)=P_1(k, n)$.

As in Embodiment 3, the reference microphone signal $P_{ref}(k, n)$ is used in Block (105) to calculate a direct sound signal denoted by $P_{dir}(k, n)$ and a diffuse sound signal denoted by $P_{diff}(k, n)$. The computation of $P_{dir}(k, n)$ and $P_{diff}(k, n)$ is explained in Embodiment 3.

As in Embodiment 3, the direct sound signal $P_{dir}(k, n)$ determined in Block (105) is combined such as multiplied 115*a* per time and frequency with the response $G_l^m(k, n)$ of the spatial basis function determined in Block (103) resulting in a direct sound Ambisonics component $B_{dir,l}^m(k, n)$ of order (level) l and mode m for the time-frequency tile (k, n). Moreover, the diffuse sound signal $P_{diff}(k, n)$ determined in Block (105) is combined such as multiplied 115*b* per time and frequency with the average response $D_l^m(k)$ of the spatial basis function determined in Block (106) resulting in a diffuse sound Ambisonics component $B_{diff,l}^m(k, n)$ of order (level) l and mode m for the time-frequency tile (k, n).

In this embodiment, the calculated diffuse sound Ambisonics component $B_{diff,l}^m(k, n)$ is decorrelated in Block (107) using a decorrelator resulting in a decorrelated diffuse sound Ambisonics component, denoted by $\tilde{B}_{diff,l}^m(k, n)$. For the decorrelation state-of-the-art decorrelation techniques can be used. Different decorrelators or realizations of the decorrelator are usually applied to the diffuse sound Ambisonics component $B_{diff,l}^m(k, n)$ of different order (level) l and mode m such that the resulting decorrelated diffuse sound Ambisonics components $\tilde{B}_{diff,l}^m(k, n)$ of different level and mode are mutually uncorrelated. In doing so, the diffuse sound Ambisonics components $\tilde{B}_{diff,l}^m(k, n)$ possess the expected physical behaviour, namely that Ambisonics components of different orders and modes are mutually uncorrelated if the sound field is ambient or diffuse [SpCoherence]. Note that the diffuse sound Ambisonics component $B_{diff,l}^m(k, n)$ may be transformed back into the time-domain using for example an inverse filterbank or an inverse STFT before applying the decorrelator (107).

Finally, the direct sound Ambisonics component $B_{dir,l}^m(k, n)$ and the decorrelated diffuse sound Ambisonics component $\tilde{B}_{diff,l}^m(k, n)$ are combined, e.g., via the summation (109), to obtain the final Ambisonics component $B_l^m(k, n)$ of the desired order (level) l and mode m for the time-frequency tile (k, n), i.e., $$B_l^m(k,n)=B_{dir,l}^m(k,n)+\tilde{B}_{diff,l}^m(k,n).$$

The resulting Ambisonics components $B_l^m(k, n)$ eventually may be transformed back into the time domain using for example an inverse filterbank or an inverse STFT, stored, transmitted, or used for example for spatial sound reproduction. In practice, one would compute the Ambisonics components for all desired orders and modes to obtain the desired Ambisonics signal of the desired maximum order (level).

It is important to emphasize that the transformation back into the time domain using for example an inverse filterbank or an inverse STFT may be carried out before computing $B_l^m(k, n)$, i.e, before the operation (109). This means, we first may transform $B_{dir,l}^m(k, n)$ and $\tilde{B}_{diff,l}^m(k, n)$ back into the time domain and then sum both components with the operation (109) to obtain the final Ambisonics component $B_l^m$. This is possible since the inverse filterbank or inverse STFT are in general linear operations. In the same way, the decorrelator (107) may be applied to the diffuse sound Ambisonics component $B_{diff,l}^m$ after transforming $B_{diff,l}^m$ back into the time domain. This may be advantageous in practice since some decorrelators operate on time-domain signals.

Furthermore, it is to be noted that a block can be added to FIG. 5, such as an inverse filterbank before the decorrelator, and the inverse filterbank can be added anywhere in the system.

As explained in Embodiment 3, the algorithm in this embodiment can be configured such that the direct sound Ambisonics components $B_{dir,l}^m(k, n)$ and diffuse sound Ambisonics component $B_{diff,l}^m(k, n)$ are computed for different modes (orders) l. For example, $B_{dir,l}^m(k, n)$ may be computed up to order l=4 whereas $B_{diff,l}^m(k, n)$ may be computed only up to order l=1. This would reduce the computational complexity.

Embodiment 5

Figure 6:
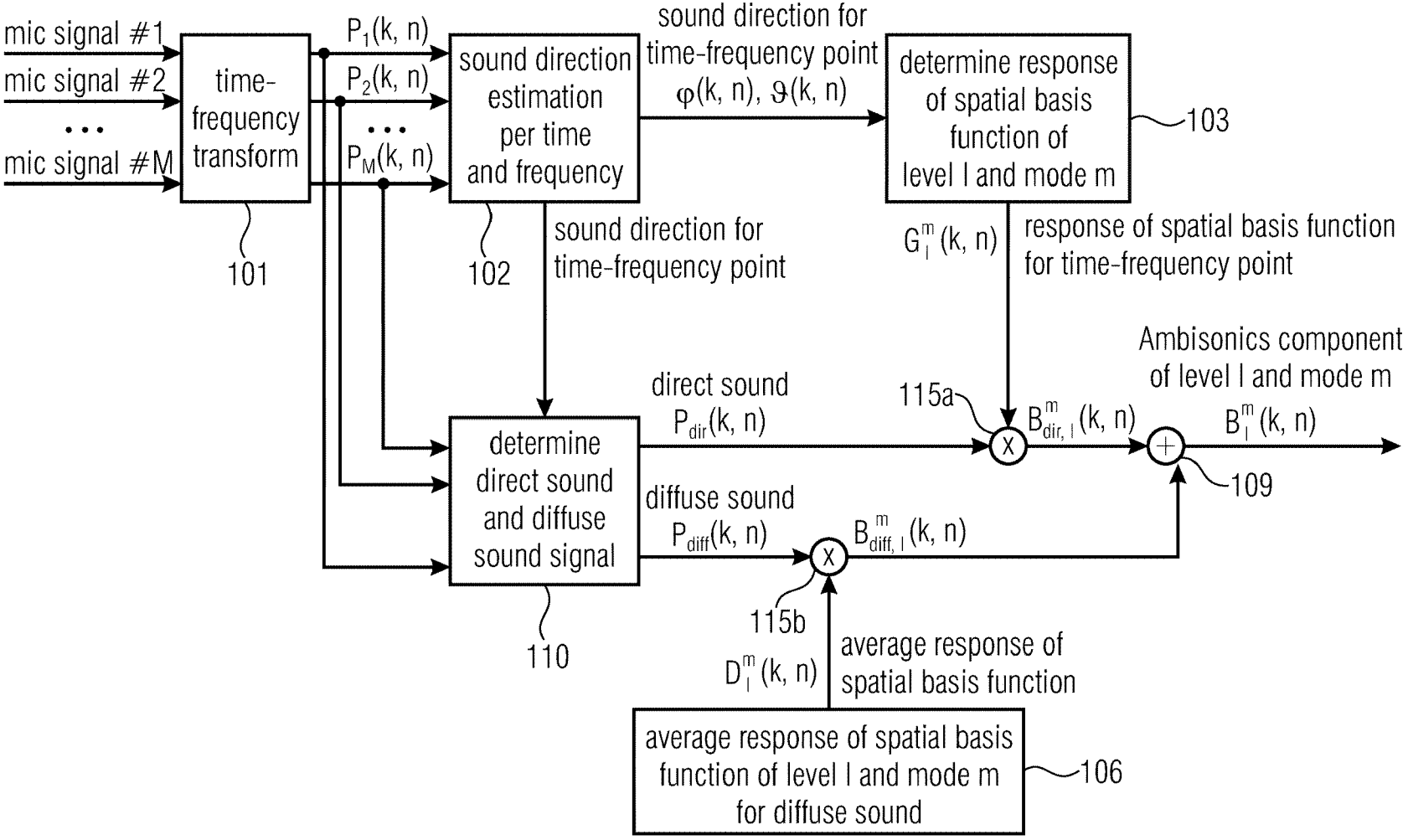
FIG. 6 shows an embodiment of the invention where the direct sound and diffuse sound are extracted from multiple microphones and sound direction information.

FIG. 6 shows another embodiment of the invention which allows to synthesize an Ambisonics component of a desired order (level) l and mode m from the signals of multiple (two or more) microphones. The embodiment is similar to Embodiment 4 but the direct sound signal and diffuse sound signal are determined from the plurality of microphone signals and by exploiting direction-of-arrival information.

As in Embodiment 4, input to the invention are the signals of multiple (two or more) microphones. The microphones may be arranged in an arbitrary geometry, for example, as a coincident setup, linear array, planar array, or three-dimensional array. Moreover, each microphone may possess an omnidirectional or an arbitrary directional directivity. The directivities of the different microphones can differ.

As in Embodiment 4, the multiple microphone signals are transformed into the time-frequency domain in Block (101) using for example a filterbank or a short-time Fourier transform (STFT). Output of the time-frequency transform (101) are the microphone signals in the time-frequency domain, which are denoted by $P_{1 \ldots M}(k, n)$. The following processing is carried out separately for the time-frequency tiles (k, n).

As in Embodiment 4, a sound direction estimation is carried out in Block (102) per time and frequency using two or more of the microphone signals $P_{1 \ldots M}(k, n)$. Corresponding estimators are discussed in Embodiment 1. The output of the sound direction estimator (102) is a sound direction per time instance n and frequency index k. The sound direction can be expressed for example in terms of a unit-norm vector n(k, n) or in terms of an azimuth angle φ(k, n) and/or elevation angle ϑ(k, n), which are related as explained in Embodiment 1.

As in Embodiment 4, the response of a spatial basis function of the desired order (level) l and mode m is determined in Block (103) per time and frequency using the estimated sound direction information. The response of the spatial basis function is denoted by $G_l^m(k, n)$. For example, we can consider real-valued spherical harmonics with N3D normalization as spatial basis function and $G_l^m(k, n)$ can be determined as explained in Embodiment 1.

As in Embodiment 4, an average response of a spatial basis function of the desired order (level) l and mode m, which is independent of the time index n, is obtained from Block (106). This average response is denoted by $D_l^m(k)$ and describes the response of a spatial basis function for sounds arriving from all possible directions (such as diffuse sounds or ambient sounds). The average response $D_l^m(k)$ can be obtained as described in Embodiment 3.

In this embodiment, a direct sound signal $P_{dir}(k, n)$ and a diffuse sound signal $P_{diff}(k, n)$ is determined in Block (110) per time index n and frequency index k from the two or more available microphone signals $P_{1 \ldots M}(k, n)$. For this purpose, Block (110) usually exploits the sound direction information which was determined in Block (102). In the following, different examples of Block (110) are explained which describe how to determine $P_{dir}(k, n)$ and $P_{diff}(k, n)$.

In a first example of Block (110), a reference microphone signal denoted by $P_{ref}(k, n)$ is determined from the multiple microphone signals $P_{1 \ldots M}(k, n)$ based on the sound direction information provided by Block (102). The reference microphone signal $P_{ref}(k, n)$ may be determined by selecting the microphone signal which is closest to the estimated sound direction for the considered time and frequency. This selection process to determine the reference microphone signal $P_{ref}(k, n)$ was explained in Embodiment 2. After determining $P_{ref}(k, n)$, a direct sound signal $P_{dir}(k, n)$ and a diffuse sound signal $P_{diff}(k, n)$ can be calculated for example by applying single-channel filters $W_{dir}(k, n)$ and $W_{diff}(k, n)$, respectively, to the reference microphone signal $P_{ref}(k, n)$. This approach and the computation of the corresponding single-channel filters was explained in Embodiment 3.

In a second example of Block (110), we determine a reference microphone signal $P_{ref}(k, n)$ as in the previous example and compute $P_{dir}(k, n)$ by applying a single-channel filter $W_{dir}(k, n)$ to $P_{ref}(k, n)$. To determine the diffuse signal, however, we select a second reference signal $P_{ref,l}^m(k, n)$ and apply a single-channel filter $W_{diff}(k, n)$ to the second reference signal $P_{ref,l}^m(k, n)$, i.e., $$P_{diff}(k,n)=W_{diff}(k,n)P_{ref,l}^m(k,n).$$

The filter $W_{diff}(k, n)$ can be computed as explained for example in Embodiment 3. The second reference signal $P_{ref,l}^{m}(k, n)$ corresponds to one of the available microphone signals $P_{1 \ldots M}(k, n)$. However, for different orders l and modes m we may use different microphone signals as second reference signal. For example, for level l=1 and mode m=−1, we may use the first microphone signal as second reference signal, i.e., $P_{ref,1}^{-1}(k, n)=P_1(k, n)$. For level l=1 and mode m=0, we may use the second microphone signal, i.e., $P_{ref,1}^{0}(k, n)=P_2(k, n)$. For level l=1 and mode m=1, we may use the third microphone signal, i.e., $P_{ref,1}^{1}(k, n)=P_3(k, n)$. The available microphone signals $P_{1 \ldots M}(k, n)$ can be assigned for example randomly to the second reference signal $P_{ref,l}^{m}(k, n)$ for the different orders and modes. This is a reasonable approach in practice since for diffuse or ambient recording situations, all microphone signals usually contain similar sound power. Selecting different second reference microphone signals for different orders and modes has the advantage that the resulting diffuse sound signals are often (at least partially) mutually uncorrelated for the different orders and modes.

In a third example of Block (110), the direct sound signal $P_{dir}(k, n)$ is determined by applying a multi-channel filter denoted by $w_{dir}(n)$ to the multiple microphone signals $P_{1 \ldots M}(k, n)$, i.e., $$P_{dir}(k,n)=w_{dir}(n)p(k,n),$$

where the multi-channel filter $w_{dir}(n)$ depends on the estimated sound direction and the vector $p(k, n)=[P_1(k, n), \ldots, P_M(k, n)]^T$ contains the multiple microphone signals. There exist many different optimal multi-channel filters $w_{dir}(n)$ in literature which can be used to compute $P_{dir}(k, n)$ from sound direction information, for example the filters derived in [InformedSF]. Similarly, the diffuse sound signal $P_{diff}(k, n)$ is determined by applying a multi-channel filter denoted by $w_{diff}(n)$ to the multiple microphone signals $P_{1 \ldots M}(k, n)$, i.e., $$P_{diff}(k,n)=w_{diff}^{H}(n)p(k,n),$$

where the multi-channel filter $w_{diff}(n)$ depends on the estimated sound direction. There exist many different optimal multi-channel filters $w_{diff}(n)$ in literature which can be used to compute $P_{diff}(k, n)$, for example the filter which was derived in [DiffuseBF].

In a fourth example of Block (110), we determine $P_{dir}(k, n)$ and $P_{diff}(k, n)$ as in the previous example by applying multi-channel filters $w_{dir}(n)$ and $w_{diff}(n)$, respectively, to the microphone signals p(k, n). However, we use different filters $w_{diff}(n)$ for different orders l and modes m such that the resulting diffuse sound signals $P_{diff}(k, n)$ for the different orders l and modes m are mutually uncorrelated. These different filters $w_{diff}(n)$ which minimize the correlation between the output signals can be computed for example as explained in [CovRender].

As in Embodiment 4, the direct sound signal $P_{dir}(k, n)$ determined in Block (105) is combined such as multiplied 115*a* per time and frequency with the response $G_l^m(k, n)$ of the spatial basis function determined in Block (103) resulting in a direct sound Ambisonics component $B_{dir,l}^{m}(k, n)$ of order (level) l and mode m for the time-frequency tile (k, n). Moreover, the diffuse sound signal $P_{diff}(k, n)$ determined in Block (105) is combined such as multiplied 115*b* per time and frequency with the average response $D_l^m(k)$ of the spatial basis function determined in Block (106) resulting in a diffuse sound Ambisonics component $B_{diff,l}^{m}(k, n)$ of order (level) l and mode m for the time-frequency tile (k, n).

As in Embodiment 3, the computed direct sound Ambisonics component $B_{dir,l}^{m}(k, n)$ and the diffuse sound Ambisonics component $B_{diff,l}^{m}(k, n)$ are combined, for example, via the summation operation (109), to obtain the final Ambisonics component $B_l^m(k, n)$ of the desired order (level) l and mode m for the time-frequency tile (k, n). The resulting Ambisonics components $B_l^m(k, n)$ eventually may be transformed back into the time domain using an inverse filterbank or an inverse STFT, stored, transmitted, or used for example for spatial sound reproduction. In practice, one would compute the Ambisonics components for all desired orders and modes to obtain the desired Ambisonics signal of the desired maximum order (level). As explained in Embodiment 3, the transformation back into the time domain may be carried out before computing $B_l^m(k, n)$, i.e, before the operation (109).

Note that the algorithm in this embodiment can be configured such that the direct sound Ambisonics components $B_{dir,l}^{m}(k, n)$ and diffuse sound Ambisonics component $B_{diff,l}^{m}(k, n)$ are computed for different modes (orders) l. For example, $B_{dir,l}^{m}(k, n)$ may be computed up to order l=4 whereas $B_{diff,l}^{m}(k, n)$ may be computed only up to order l=1 (in this case, $B_{diff,l}^{m}(k, n)$ would be zero for orders larger l=1). If it is desired for example to calculate only $B_{dir,l}^{m}(k, n)$ but not $B_{diff,l}^{m}(k, n)$ for a specific order (level) l or mode m, then for example Block (110) can be configured such that the diffuse sound signal $P_{diff}(k, n)$ becomes equal to zero. This can be achieved for example by setting the filter $W_{diff}(k, n)$ in the equations before to 0 and the filter $W_{dir}(k, n)$ to 1. Similarly, the filter $w_{diff}^{H}(n)$ could be set to zero.

Embodiment 6

Figure 7:
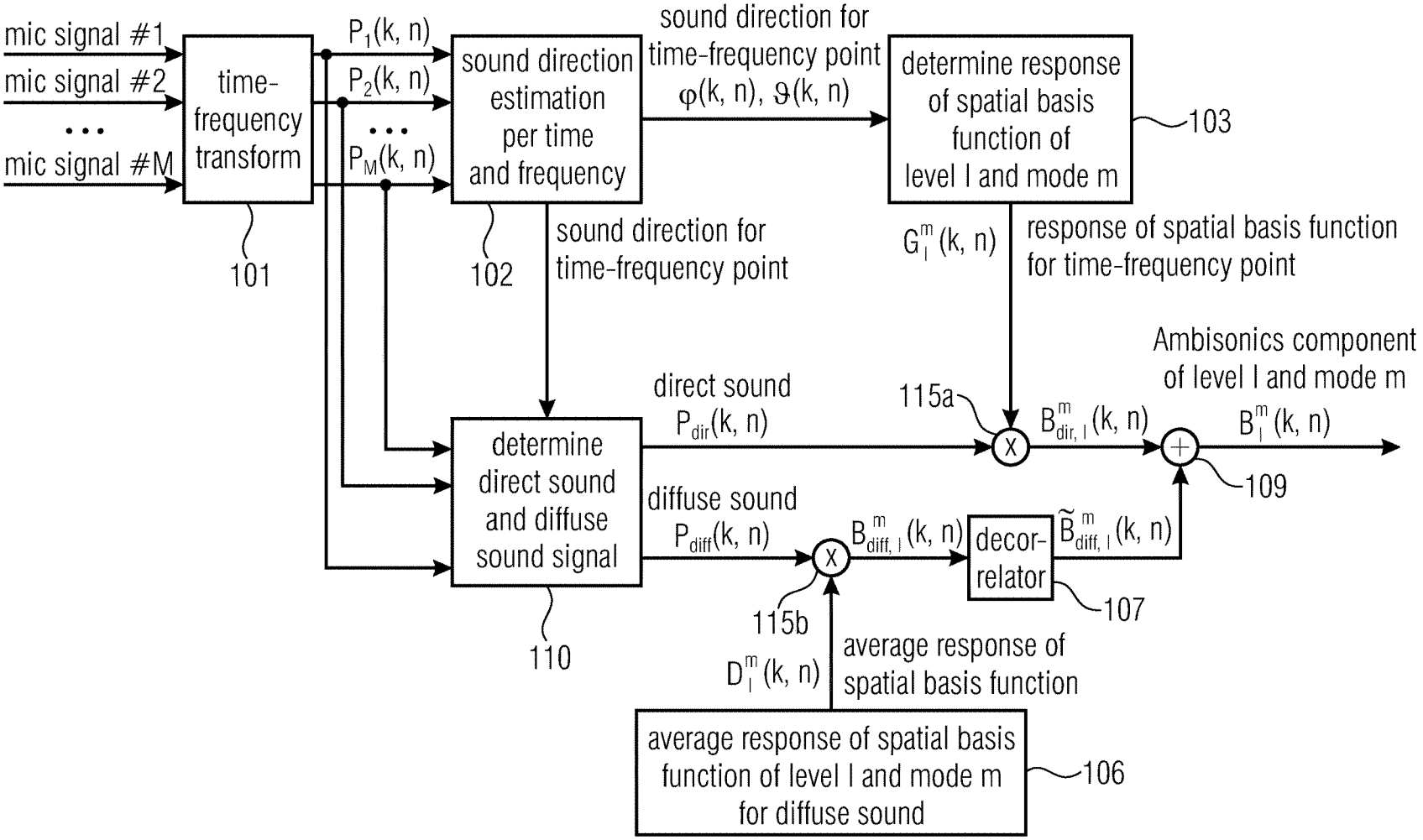
FIG. 7 shows an embodiment of the invention where the diffuse sound is extracted from multiple microphones and where the diffuse sound Ambisonics component is decorrelated.

FIG. 7 shows another embodiment of the invention which allows to synthesize an Ambisonics component of a desired order (level) l and mode m from the signals of multiple (two or more) microphones. The embodiment is similar to Embodiment 5 but additionally contains decorrelators for the diffuse Ambisonics components.

As in Embodiment 5, input to the invention are the signals of multiple (two or more) microphones. The microphones may be arranged in an arbitrary geometry, for example, as a coincident setup, linear array, planar array, or three-dimensional array. Moreover, each microphone may possess an omnidirectional or an arbitrary directional directivity. The directivities of the different microphones can differ.

As in Embodiment 5, the multiple microphone signals are transformed into the time-frequency domain in Block (101) using for example a filterbank or a short-time Fourier transform (STFT). Output of the time-frequency transform (101) are the microphone signals in the time-frequency domain, which are denoted by $P_{1 \ldots M}(k, n)$. The following processing is carried out separately for the time-frequency tiles (k, n).

As in Embodiment 5, a sound direction estimation is carried out in Block (102) per time and frequency using two or more of the microphone signals $P_{1 \ldots M}(k, n)$. Corresponding estimators are discussed in Embodiment 1. The output of the sound direction estimator (102) is a sound direction per time instance n and frequency index k. The sound direction can be expressed for example in terms of a unit-norm vector n(k, n) or in terms of an azimuth angle φ(k, n) and/or elevation angle ϑ(k, n), which are related as explained in Embodiment 1.

As in Embodiment 5, the response of a spatial basis function of the desired order (level) l and mode m is determined in Block (103) per time and frequency using the estimated sound direction information. The response of the spatial basis function is denoted by $G_l^m(k, n)$. For example, we can consider real-valued spherical harmonics with N3D normalization as spatial basis function and $G_l^m(k, n)$ can be determined as explained in Embodiment 1.

As in Embodiment 5, an average response of a spatial basis function of the desired order (level) l and mode m, which is independent of the time index n, is obtained from Block (106). This average response is denoted by $D_l^m(k)$ and describes the response of a spatial basis function for sounds arriving from all possible directions (such as diffuse sounds or ambient sounds). The average response $D_l^m(k)$ can be obtained as described in Embodiment 3.

As in Embodiment 5, a direct sound signal $P_{dir}(k, n)$ and a diffuse sound signal $P_{diff}(k, n)$ is determined in Block (110) per time index n and frequency index k from the two or more available microphone signals $P_{1 \ldots M}(k, n)$. For this purpose, Block (110) usually exploits the sound direction information which was determined in Block (102). Different examples of Block (110) are explained in Embodiment 5.

As in Embodiment 5, the direct sound signal $P_{dir}(k, n)$ determined in Block (105) is combined such as multiplied 115*a* per time and frequency with the response $G_l^m(k, n)$ of the spatial basis function determined in Block (103) resulting in a direct sound Ambisonics component $B_{dir,l}^m(k, n)$ of order (level) l and mode m for the time-frequency tile (k, n). Moreover, the diffuse sound signal $P_{diff}(k, n)$ determined in Block (105) is combined such as multiplied 115*b* per time and frequency with the average response $D_l^m(k)$ of the spatial basis function determined in Block (106) resulting in a diffuse sound Ambisonics component $B_{diff,l}^m(k, n)$ of order (level) l and mode m for the time-frequency tile (k, n).

As in Embodiment 4, the calculated diffuse sound Ambisonics component $B_{diff,l}^m(k, n)$ is decorrelated in Block (107) using a decorrelator resulting in a decorrelated diffuse sound Ambisonics component, denoted by $\tilde{B}_{diff,l}^m(k, n)$. The reasoning and methods behind the decorrelation are discussed in Embodiment 4. As in Embodiment 4, the diffuse sound Ambisonics component $B_{diff,l}^m(k, n)$ may be transformed back into the time-domain using for example an inverse filterbank or an inverse STFT before applying the decorrelator (107).

As in Embodiment 4, the direct sound Ambisonics component $B_{dir,l}^m(k, n)$ and decorrelated diffuse sound Ambisonics component $\tilde{B}_{diff,l}^m(k, n)$ are combined, for example, via the summation operation (109), to obtain the final Ambisonics component $B_l^m(k, n)$ of the desired order (level) l and mode m for the time-frequency tile (k, n). The resulting Ambisonics components $B_l^m(k, n)$ eventually may be transformed back into the time domain using an inverse filterbank or an inverse STFT, stored, transmitted, or used for example for spatial sound reproduction. In practice, one would compute the Ambisonics components for all desired orders and modes to obtain the desired Ambisonics signal of the desired maximum order (level). As explained in Embodiment 4, the transformation back into the time domain may be carried out before computing $B_l^m(k, n)$, i.e, before the operation (109).

As in Embodiment 4, the algorithm in this embodiment can be configured such that the direct sound Ambisonics components $B_{dir,l}^m(k, n)$ and diffuse sound Ambisonics component $B_{diff,l}^m(k, n)$ are computed for different modes (orders) l. For example, $B_{dir,l}^m(k, n)$ may be computed up to order l=4 whereas $B_{diff,l}^m(k, n)$ may be computed only up to order l=1.

Embodiment 7

Figure 8:
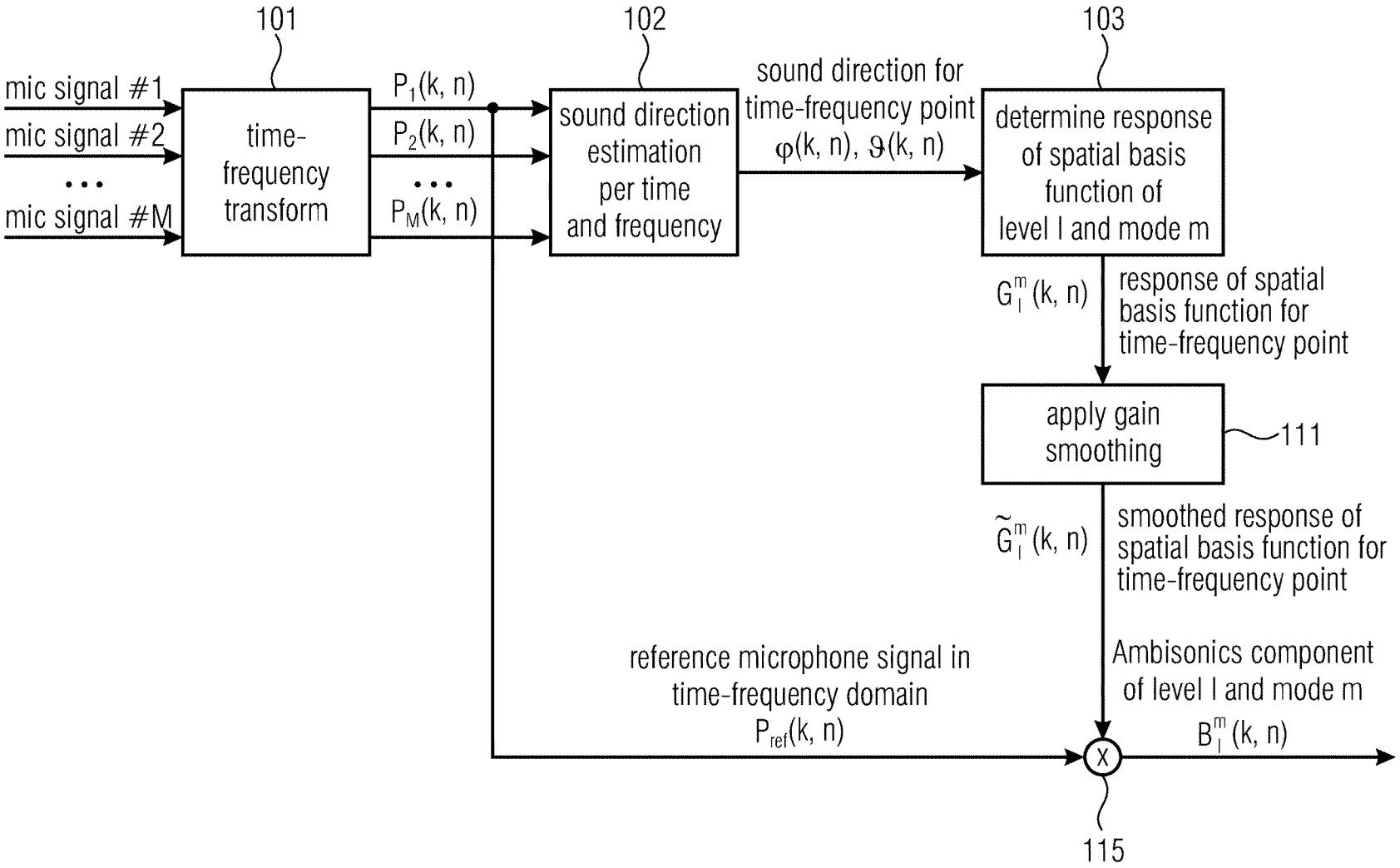
FIG. 8 shows an embodiment of the invention where a gain smoothing is applied to the spatial basis function response.

FIG. 8 shows another embodiment of the invention which allows to synthesize an Ambisonics component of a desired order (level) l and mode m from the signals of multiple (two or more) microphones. The embodiment is similar to Embodiment 1 but additionally contains a Block (111) which applies a smoothing operation to the calculated response $G_l^m(k, n)$ of the spatial basis function.

As in Embodiment 1, input to the invention are the signals of multiple (two or more) microphones. The microphones may be arranged in an arbitrary geometry, for example, as a coincident setup, linear array, planar array, or three-dimensional array. Moreover, each microphone may possess an omnidirectional or an arbitrary directional directivity. The directivities of the different microphones can differ.

As in Embodiment 1, the multiple microphone signals are transformed into the time-frequency domain in Block (101) using for example a filterbank or a short-time Fourier transform (STFT). Output of the time-frequency transform (101) are the microphone signals in the time-frequency domain, which are denoted by $P_{1 \ldots M}(k, n)$. The following processing is carried out separately for the time-frequency tiles (k, n).

As in Embodiment 1, without loss of generality, the first microphone signal is referred to as the reference microphone signal, i.e., $P_{ref}(k, n)=P_1(k, n)$.

As in Embodiment 1, a sound direction estimation is carried out in Block (102) per time and frequency using two or more of the microphone signals $P_{1 \ldots M}(k, n)$. Corresponding estimators are discussed in Embodiment 1. The output of the sound direction estimator (102) is a sound direction per time instance n and frequency index k. The sound direction can be expressed for example in terms of a unit-norm vector n(k, n) or in terms of an azimuth angle $\varphi(k, n)$ and/or elevation angle $\vartheta(k, n)$, which are related as explained in Embodiment 1.

As in Embodiment 1, the response of a spatial basis function of the desired order (level) l and mode m is determined in Block (103) per time and frequency using the estimated sound direction information. The response of the spatial basis function is denoted by $G_l^m(k, n)$. For example, we can consider real-valued spherical harmonics with N3D normalization as spatial basis function and $G_l^m(k, n)$ can be determined as explained in Embodiment 1.

In contrast to Embodiment 1, the response $G_l^m(k, n)$ is used as input to Block (111) which applies a smoothing operation to $G_l^m(k, n)$. The output of Block (111) is a smoothed response function denoted as $G_l^m(k, n)$. The aim of the smoothing operation is to reduce an undesired estimation variance of the values of $G_l^m(k, n)$, which can occur in practice for example if the sound directions $\varphi(k, n)$ and/or $\vartheta(k, n)$, estimated in Block (102), are noisy. The smoothing, applied to $G_l^m(k, n)$, can be carried out for example across time and/or frequency. For example, a temporal smoothing can be achieved using the well-known recursive averaging filter $$\overline{G}_l^m(k,n)=\alpha G_l^m(k,n)+(1-\alpha)G_l^m(k,n-1),$$

where $G_l^m(k, n-1)$ is the response function computed in the previous time frame. Moreover, a is a real-valued number between 0 and 1 which controls the strength of the temporal smoothing. For values of $\alpha$ close to 0, a strong temporal averaging is carried out, whereas for values of $\alpha$ close to 1, a short temporal averaging is carried out. In practical applications, the value of $\alpha$ depends on the application and can be set constant, for example, $\alpha=0.5$. Alternatively, a spectral smoothing can be carried out in Block (111) as well, which means that the response $G_l^m(k, n)$ is averaged across multiple frequency bands. Such a spectral smoothing, for example within so-called ERB bands, is described for example in [ERBsmooth].

In this embodiment, the reference microphone signal $P_{ref}(k, n)$ finally is combined such as multiplied 115 per time and frequency with the smoothed response $\overline{G}_l^m(k, n)$ of the spatial basis function determined in Block (111) resulting in the desired Ambisonics component $B_l^m(k, n)$ of order (level) l and mode m for the time-frequency tile (k, n). The resulting Ambisonics components $B_l^m(k, n)$ eventually may be transformed back into the time domain using an inverse filterbank or an inverse STFT, stored, transmitted, or used for example for spatial sound reproduction. In practice, one would compute the Ambisonics components for all desired orders and modes to obtain the desired Ambisonics signal of the desired maximum order (level).

Clearly, the gain smoothing in Block (111) can be applied also in all other embodiments of this invention.

Embodiment 8

The present invention can be applied also in the so-called multi-wave case, where more than one sound direction is considered per time-frequency tile. For example, Embodiment 2, illustrated in FIG. 3B, can be realized in the multi-wave case. In this case, Block (102) estimates J sound directions per time and frequency, where J is an integer value larger one, for example, J=2. To estimate multiple sound directions, state-of-the-art estimators can be used, for example ESPRIT or Root MUSIC, which are described in [ESPRIT,RootMUSIC1]. In this case, output of Block (102) are multiple sound directions, indicated for example in terms of multiple azimuth angles $\varphi_{1 \ldots J}(k, n)$ and/or elevation angles $\vartheta_{1 \ldots J}(k, n)$.

The multiple sound directions are then used in Block (103) to compute multiple responses $G_{l,1 \ldots J}(k, n)$, one response for each estimated sound direction as discussed for example in Embodiment 1. Moreover, the multiple sound directions calculated in Block (102) are used in Block (104) to calculate multiple reference signals $P_{ref,1 \ldots J}(k, n)$, one for each of the multiple sound directions. Each of the multiple reference signals can be calculated for example by applying multi-channel filters $w_{1 \ldots J}(n)$ to the multiple microphone signals, similarly as explained in Embodiment 2. For example, the first reference signal $P_{ref,1}(k, n)$ can be obtained by applying a state-of-the-art multi-channel filter $w_1(n)$, which would extract sounds from the direction $\varphi_1(k, n)$ and/or $\vartheta_1(k, n)$ while attenuating sounds from all other sound directions. Such a filter can be computed for example as the informed LCMV filter which is explained in [InformedSF]. The multiple reference signals $P_{ref,1 \ldots J}(k,n)$ are then multiplied with the corresponding multiple responses $G_{l,1 \ldots J}^m(k, n)$ to obtain multiple Ambisonics components $B_{l,1 \ldots J}^m(k, n)$, For example, the j-th Ambisonics component corresponding to the j-th sound direction and reference signal, respectively, is calculated as $$B_{l,j}^m(k,n)=P_{ref,j}(k,n)G_{l,j}^m(k,n).$$

Finally, the J Ambisonics components are summed to obtain the final desired Ambisonics component $B_l^m(k, n)$ of order (level) l and mode m for the time-frequency tile (k, n), i.e., $$B_l^m(k, n) = \sum_{j=1}^{J} B_{l,j}^m(k, n).$$

Clearly, also the other aforementioned embodiments can be extended to the multi-wave case. For example, in Embodiment 5 and Embodiment 6 we can calculate multiple direct sounds $P_{dir,1 \ldots J}(k, n)$, one for each of the multiple sound directions, using the same multi-channel filters as mentioned in this embodiment. The multiple direct sounds are then multiplied with corresponding multiple responses $G_{l,1 \ldots J}^m(k, n)$ leading to multiple direct sound Ambisonics components $B_{dir,l,1 \ldots J}^m(k, n)$ which can be summed to obtain the final desired direct sound Ambisonics component $B_{dir,l}^m(k, n)$.

It is to be noted that the invention can not only be applied to the two dimensional (cylindrical) or three-dimensional (spherical) Ambisonics techniques but also to any other techniques relying on spatial basis functions for calculating any sound field components.

Embodiments of the Invention as a List

1. Transform multiple microphone signals into the time frequency domain.
2. Calculate one or more sound directions per time and frequency from the multiple microphone signals.
3. Compute for each time and frequency one or more response functions depending on the one or more sound directions.
4. For each time and frequency obtain one or more reference microphone signals.
5. For each time and frequency, multiply the one or more reference microphone signals with the one or more response functions to obtain one or more Ambisonics components of the desired order and mode.
6. If multiple Ambisonics components were obtained for the desired order and mode, sum up the corresponding Ambisonics components to obtain the final desired Ambisonics component.
4. In some Embodiments, compute in Step 4 one or more direct sounds and diffuse sounds from the multiple microphone signals instead of the one or more reference microphone signals.
5. Multiply the one or more direct sounds and diffuse sounds with one or more corresponding direct sound responses and diffuse sound responses to obtain one or more direct sound Ambisonics components and diffuse sound Ambisonics components for the desired order and mode.
6. The diffuse sound Ambisonics components may be additionally decorrelated for different orders and modes.
7. Sum up the direct sound Ambisonics components and diffuse sound Ambisonics components to obtain the final desired Ambisonics component of the desired order and mode.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for generating a sound field description comprising a representation of sound field components, comprising:

a direction determiner for determining one or more sound directions for each time-frequency tile of a plurality of time-frequency tiles of a plurality of microphone signals;

a spatial basis function evaluator for evaluating, for each time-frequency tile of the plurality of time-frequency tiles, one or more spatial basis functions using the one or more sound directions; and a sound field component calculator for calculating, for each time-frequency tile of the plurality of time-frequency tiles, one or more sound field components corresponding to the one or more spatial basis functions using the one or more spatial basis functions evaluated using the one or more sound directions and using a reference signal for a corresponding time-frequency tile, the reference signal being derived from one or more microphone signals of the plurality of microphone signals, wherein the apparatus further comprises a direct or diffuse sound determiner for determining a direct portion or a diffuse portion of the plurality of microphone signals, as the reference signal, wherein the sound field component calculator is configured to use the direct portion only in calculating one or more direct sound field components, and wherein the apparatus further comprises an average response basis function determiner for determining an average spatial basis function response, the average response basis function determiner comprising a calculation process or a look up table access process; and a diffuse sound component calculator, for calculating one or more diffuse sound field components using only the diffuse portion as the reference signal together with the average spatial basis function response, or wherein the apparatus further comprises a direct or diffuse sound determiner for determining a direct portion or a diffuse portion of the plurality of microphone signals, as the reference signal, wherein the sound field component calculator is configured to use the direct portion only in calculating one or more direct sound field components, wherein the diffuse sound component calculator is configured to calculate diffuse sound components up to a predetermined first number or order, wherein the sound field component calculator is configured to calculate direct sound field components up to a predetermined second number or order, wherein the predetermined second number or order is greater than the predetermined first number or order, and wherein the predetermined first number or order is 1 or greater than 1.

2. The apparatus of claim 1, further comprising:

a diffuse component calculator for calculating, for each time-frequency tile of the plurality of time-frequency tiles, one or more diffuse sound components; and a combiner for combining diffuse sound information and direct sound field information to acquire a frequency domain representation or a time domain representation of the sound field components.

3. The apparatus of claim 2, wherein the diffuse component calculator further comprises a decorrelator for decorrelating diffuse sound information.

4. The apparatus of claim 1, further comprising a time-frequency converter for converting each of a plurality of time domain microphone signals into a frequency representation comprising the plurality of time-frequency tiles.

5. The apparatus of claim 1, further comprising a frequency-time converter for converting the one or more sound field components or a combination of the one or more sound field components and diffuse sound components into a time domain representation of the sound field components.

6. The apparatus of claim 5, wherein the frequency-time converter is configured to process the one or more sound field components to acquire a plurality of time domain sound field components, wherein the frequency-time converter is configured to process the diffuse sound components to acquire a plurality of time domain diffuse components, and wherein a combiner is configured to perform a combination of the time domain sound field components and the time domain diffuse components in the time domain; or wherein a combiner is configured to combine the one or more sound field components for a time-frequency tile and the diffuse sound components for the corresponding time-frequency tile in the frequency domain, and wherein the frequency-time converter is configured to process a result of the combiner to acquire the sound field components in the time domain.

7. The apparatus of claim 1, further comprising a reference signal calculator for calculating the reference signal from the plurality of microphone signals using the one or more sound directions, using selecting a specific microphone signal from the plurality of microphone signals based on the one or more sound directions, or using a multichannel filter applied to two or more microphone signals, the multichannel filter depending on the one or more sound directions and individual positions of the microphones, from which the plurality of microphone signals are acquired.

8. The apparatus of claim 1, wherein the spatial basis function evaluator is configured to use for a spatial basis function, a parameterized representation, wherein a parameter of the parameterized representation is a sound direction, and to insert a parameter corresponding to the sound direction into the parameterized representation to acquire an evaluation result for each spatial basis function; or wherein the spatial basis function evaluator is configured to use a look-up table for each spatial basis function comprising, as an input, a spatial basis function identification, and the sound direction, and comprising, as an output, an evaluation result, and wherein the spatial basis function evaluator is configured to determine, for the one or more sound directions determined by the direction determiner, a corresponding sound direction of the look-up table input or to calculate a weighted or unweighted mean between two look-up table inputs neighboring the one or more sound directions determined by the direction determiner; or wherein the spatial basis function evaluator is configured to use for a spatial basis function, a parameterized representation, wherein a parameter of the parameterized representation is a sound direction, the sound direction being one-dimensional, in a two-dimensional situation or two-dimensional, in a three-dimensional situation, and to insert a parameter corresponding to the sound direction into the parameterized representation to acquire an evaluation result for each spatial basis function.

9. The apparatus of claim 1, further comprising:

a direct or diffuse sound determiner for determining a direct portion or a diffuse portion of the plurality of microphone signals, as the reference signal, wherein the sound field component calculator is configured to use the direct portion only in calculating one or more direct sound field components.

10. The apparatus of claim 1, further comprising a combiner for combining a direct sound field component;

and a diffuse sound field component to acquire the sound field component.

11. The apparatus of claim 1, wherein the diffuse signal component calculator comprises a decorrelator for decorrelating a diffuse sound component before or subsequent to a combination with an average response of a spatial basis function in a frequency domain representation or a time domain representation.

12. The apparatus of claim 9, wherein the direct or diffuse sound determiner is configured to:

calculate the direct portion and the diffuse portion from a single microphone signal, and wherein the diffuse sound component calculator is configured to calculate the one or more diffuse sound components using the diffuse portion as the reference signal, and wherein the sound field component calculator is configured to calculate the one or more direct sound field components using the direct portion as the reference signal; or calculate a diffuse portion from a microphone signal being different from the microphone signal, from which the direct portion is calculated, and wherein the diffuse sound component calculator is configured to calculate the one or more diffuse sound components using the diffuse portion as the reference signal, and wherein the sound field component calculator is configured to calculate the one or more direct sound field components using the direct portion as the reference signal; or calculate a diffuse portion for a different spatial basis function using a different microphone signal, and wherein the diffuse sound component calculator is configured for using a first diffuse portion as the reference signal for an average spatial basis function response corresponding to a first number, and to use a different second diffuse portion as the reference signal corresponding to a second number average spatial basis function response, wherein the first number is different from the second number, and wherein the first number and the second number indicate any order or level and mode of the one or more spatial basis functions; or calculate the direct portion using a first multichannel filter applied to the plurality of microphone signals and calculating the diffuse portion using a second multichannel filter applied to the plurality of microphone signals, the second multichannel filter being different from the first multichannel filter, and wherein the diffuse sound component calculator is configured to calculate the one or more diffuse sound components using the diffuse portion as the reference signal, and wherein the sound field component calculator is configured to calculate the one or more direct sound field components using the direct portion as the reference signal; or calculate the diffuse portions for different spatial basis functions using different multichannel filters for the different spatial basis functions, and wherein the diffuse sound component calculator is configured to calculate the one or more diffuse sound components using the diffuse portion as the reference signal, and wherein the sound field component calculator is configured to calculate the one or more direct sound field components using the direct portion as the reference signal.

13. The apparatus of claim 1, wherein the spatial basis function evaluator comprises a gain smoother operating in a time direction or a frequency direction, for smoothing evaluation results, and wherein the sound field component calculator is configured to use smoothed evaluator results in calculating the one or more sound field components.

14. The apparatus of claim 1, wherein the spatial basis function evaluator is configured to use the one or more spatial basis functions for Ambisonics in a two-dimensional or a three-dimensional situation.

15. The apparatus of claim 14, wherein the spatial basis function calculator is configured to use at least the spatial basis functions of at least two levels or orders or at least two modes.

16. The apparatus of claim 15, wherein the sound field component calculator is configured to calculate the sound field component for at least two levels of a group of levels comprising level 0, level 1, level 2, level 3, level 4, or wherein the sound field component calculator is configured to calculate the sound field components for at least two modes of the group of modes comprising mode −4, mode −3, mode −2, mode −1, mode 0, mode 1, mode 2, mode 3, mode 4.

17. The apparatus of claim 1, wherein the certain order or number is one or zero, and the order or number up to which the sound field component calculator is configured to calculate a sound field component is 2 or more.

18. A method of generating a sound field description comprising a representation of sound field components, comprising:

determining one or more sound directions for each time-frequency tile of a plurality of time-frequency tiles of a plurality of microphone signals;

evaluating, for each time-frequency tile of the plurality of time-frequency tiles, one or more spatial basis functions using the one or more sound directions; and calculating, for each time-frequency tile of the plurality of time-frequency tiles, one or more sound field components corresponding to the one or more spatial basis functions using the one or more spatial basis functions evaluated using the one or more sound directions and using a reference signal for a corresponding time-frequency tile, the reference signal being derived from one or more microphone signals of the plurality of microphone signals, wherein the method further comprises determining a direct portion or a diffuse portion of the plurality of microphone signals, as the reference signal, wherein the calculating comprises using the direct portion only in calculating one or more direct sound field components, and wherein the method further comprises determining an average spatial basis function response, using a calculation process or a look up table access process; and calculating one or more diffuse sound field components using only the diffuse portion as the reference signal together with the average spatial basis function response, or wherein the method further comprises determining a direct portion or a diffuse portion of the plurality of microphone signals, as the reference signal, wherein the calculating comprises using the direct portion only in calculating one or more direct sound field components, wherein diffuse sound components are calculated up to a predetermined first number or order, wherein the calculating comprises calculating direct sound field components up to a predetermined second number or order, wherein the predetermined second number or order is greater than the predetermined first number or order, and wherein the predetermined first number or order is 1 or greater than 1.

19. A non-transitory digital storage medium having a computer program stored thereon to perform, when said computer program is run by a computer, a method of generating a sound field description comprising a representation of sound field components, the method comprising:

determining one or more sound directions for each time-frequency tile of a plurality of time-frequency tiles of a plurality of microphone signals;

evaluating, for each time-frequency tile of the plurality of time-frequency tiles, one or more spatial basis functions using the one or more sound directions; and calculating, for each time-frequency tile of the plurality of time-frequency tiles, one or more sound field components corresponding to the one or more spatial basis functions using the one or more spatial basis functions evaluated using the one or more sound directions and using a reference signal for a corresponding time-frequency tile, the reference signal being derived from one or more microphone signals of the plurality of microphone signals, wherein the method further comprises determining a direct portion or a diffuse portion of the plurality of microphone signals, as the reference signal, wherein the calculating comprises using the direct portion only in calculating one or more direct sound field components, and wherein the method further comprises determining an average spatial basis function response, using a calculation process or a look up table access process; and calculating one or more diffuse sound field components using only the diffuse portion as the reference signal together with the average spatial basis function response, or wherein the method further comprises determining a direct portion or a diffuse portion of the plurality of microphone signals, as the reference signal, wherein the calculating comprises using the direct portion only in calculating one or more direct sound field components, wherein diffuse sound components are calculated up to a predetermined first number or order, wherein the calculating comprises calculating direct sound field components up to a predetermined second number or order, wherein the predetermined second number or order is greater than the predetermined first number or order, and wherein the predetermined first number or order is 1 or greater than 1.

20. An apparatus for generating a sound field description comprising a representation of sound field components, comprising:

a direction determiner for determining one or more sound directions for each time-frequency tile of a plurality of time-frequency tiles of a plurality of microphone signals;

a spatial basis function evaluator for evaluating, for each time-frequency tile of the plurality of time-frequency tiles, one or more spatial basis functions using the one or more sound directions; and a sound field component calculator for calculating, for each time-frequency tile of the plurality of time-frequency tiles, one or more sound field components corresponding to the one or more spatial basis functions using the one or more spatial basis functions evaluated using the one or more sound directions and using a reference signal for a corresponding time-frequency tile, the reference signal being derived from one or more microphone signals of the plurality of microphone signals, wherein the spatial basis function evaluator is configured to calculate, for a time-frequency tile, for each sound direction of at least two sound directions, determined by the direction determiner, an evaluation result, for each spatial basis function of the one or more two spatial basis functions, wherein a reference signal calculator is configured to calculate, for each sound direction, separate reference signals, wherein the sound field component calculator is configured to calculate the sound field component for each direction using the evaluation result for the sound direction and the reference signal for the sound direction, and wherein the sound field component calculator is configured to add sound field components for different directions calculated using a spatial basis function to acquire the sound field component for the spatial basis function in a time-frequency tile, or a diffuse component calculator for calculating, for each time-frequency tile of the plurality of time-frequency tiles, one or more diffuse sound components; and a combiner for combining diffuse sound information and direct sound field information to acquire a frequency domain representation or a time domain representation of the sound field components, wherein the diffuse component calculator or the combiner is configured to calculate or to combine a diffuse component until a certain order or number, the certain order or number being smaller than an order or number up to which the sound field component calculator is configured to calculate a direct sound field component, or wherein the sound field component calculator is configured to multiply a signal in a time-frequency tile of the reference signal by an evaluation result acquired from a spatial basis function to acquire information on a sound field component associated with the spatial basis function, and to multiply the signal in the time-frequency tile of the reference signal by a further evaluation result acquired from a further spatial basis function to acquire information on a further sound field component associated with the further spatial basis function.

21. A method of generating a sound field description comprising a representation of sound field components, comprising:

determining one or more sound directions for each time-frequency tile of a plurality of time-frequency tiles of a plurality of microphone signals;

evaluating, for each time-frequency tile of the plurality of time-frequency tiles, one or more spatial basis functions using the one or more sound directions; and calculating, for each time-frequency tile of the plurality of time-frequency tiles, one or more sound field components corresponding to the one or more spatial basis functions using the one or more spatial basis functions evaluated using the one or more sound directions and using a reference signal for a corresponding time-frequency tile, the reference signal being derived from one or more microphone signals of the plurality of microphone signals, wherein the evaluating comprises calculating, for a time-frequency tile, for each sound direction of at least two sound directions, determined by the determining, an evaluation result, for each spatial basis function of the one or more two spatial basis functions, wherein for each sound direction, separate reference signals are calculated, wherein the calculating comprises calculating the sound field component for each direction using the evaluation result for the sound direction and the reference signal for the sound direction, and wherein the calculating comprises adding sound field components for different directions calculated using a spatial basis function to acquire the sound field component for the spatial basis function in a time-frequency tile, or calculating, for each time-frequency tile of the plurality of time-frequency tiles, one or more diffuse sound components, and combining diffuse sound information and direct sound field information to acquire a frequency domain representation or a time domain representation of the sound field components, wherein the calculating one or more diffuse sound components diffuse or the combining comprises calculating or combining a diffuse component until a certain order or number, the certain order or number being smaller than an order or number up to which the calculating calculates a direct sound field component, or wherein the calculating comprises multiplying a signal in a time-frequency tile of the reference signal by an evaluation result acquired from a spatial basis function to acquire information on a sound field component associated with the spatial basis function, and multiplying the signal in the time-frequency tile of the reference signal by a further evaluation result acquired from a further spatial basis function to acquire information on a further sound field component associated with the further spatial basis function.

22. A non-transitory digital storage medium having a computer program stored thereon to perform, when said computer program is run by a computer, a method of generating a sound field description comprising a representation of sound field components, the method comprising:

determining one or more sound directions for each time-frequency tile of a plurality of time-frequency tiles of a plurality of microphone signals;

evaluating, for each time-frequency tile of the plurality of time-frequency tiles, one or more spatial basis functions using the one or more sound directions; and calculating, for each time-frequency tile of the plurality of time-frequency tiles, one or more sound field components corresponding to the one or more spatial basis functions using the one or more spatial basis functions evaluated using the one or more sound directions and using a reference signal for a corresponding time-frequency tile, the reference signal being derived from one or more microphone signals of the plurality of microphone signals, wherein the evaluating comprises calculating, for a time-frequency tile, for each sound direction of at least two sound directions, determined by the determining, an evaluation result, for each spatial basis function of the one or more two spatial basis functions, wherein for each sound direction, separate reference signals are calculated, wherein the calculating comprises calculating the sound field component for each direction using the evaluation result for the sound direction and the reference signal for the sound direction, and wherein the calculating comprises adding sound field components for different directions calculated using a spatial basis function to acquire the sound field component for the spatial basis function in a time-frequency tile, or calculating, for each time-frequency tile of the plurality of time-frequency tiles, one or more diffuse sound components, and combining diffuse sound information and direct sound field information to acquire a frequency domain representation or a time domain representation of the sound field components, wherein the calculating one or more diffuse sound components diffuse or the combining comprises calculating or combining a diffuse component until a certain order or number, the certain order or number being smaller than an order or number up to which the calculating calculates a direct sound field component, or wherein the calculating comprises multiplying a signal in a time-frequency tile of the reference signal by an evaluation result acquired from a spatial basis function to acquire information on a sound field component associated with the spatial basis function, and multiplying the signal in the time-frequency tile of the reference signal by a further evaluation result acquired from a further spatial basis function to acquire information on a further sound field component associated with the further spatial basis function.

* * * * *